US010670354B2

(12) United States Patent
Schenker et al.

(10) Patent No.: US 10,670,354 B2
(45) **Date of Patent: *Jun. 2, 2020**

(54) FIREARM WITH LOCKING LUG BOLT, AND COMPONENTS THEREOF, FOR ACCURATE FIELD SHOOTING

(71) Applicant: Ronald Andrew Foster, Boise, ID (US)

(72) Inventors: David Paul Schenker, Boise, ID (US); Patrick Edwin Johnston, Boise, ID (US)

(73) Assignee: Ronald Andrew Foster, Boise, ID (US)

( * ) Notice: Subject to any disclaimer, the term of this patent is extended or adjusted under 35 U.S.C. 154(b) by 14 days.

This patent is subject to a terminal disclaimer.

(21) Appl. No.: 16/190,063

(22) Filed: Nov. 13, 2018

(65) Prior Publication Data

US 2019/0086167 A1 Mar. 21, 2019

Related U.S. Application Data

(63) Continuation of application No. 15/047,569, filed on Feb. 18, 2016, now Pat. No. 10,132,579.

(51) Int. Cl.

| | |
|---|---|
| ***F41A 3/22*** | (2006.01) |
| ***F41A 3/66*** | (2006.01) |
| ***F41A 21/48*** | (2006.01) |

(52) U.S. Cl.

CPC ..... *F41A 3/22* (2013.01); *F41A 3/66* (2013.01); *F41A 21/482* (2013.01)

(58) Field of Classification Search

CPC ..... F41A 3/16; F41A 3/22; F41A 3/30; F41A 3/34; F41A 3/66

See application file for complete search history.

(56) References Cited

U.S. PATENT DOCUMENTS

| | | | |
|---|---|---|---|
| 2,425,684 | A | 8/1947 | Patchett |
| 3,889,574 | A | 6/1975 | Sanford |
| 4,152,855 | A | 5/1979 | Dubiel et al. |
| 4,547,988 | A | 10/1985 | Nilsson |
| 4,655,118 | A | 4/1987 | Bruderer et al. |
| 4,723,369 | A | 2/1988 | Badali |
| 4,930,238 | A | 6/1990 | Poff |
| 5,233,124 | A | 8/1993 | Peterson |
| 5,926,988 | A | 7/1999 | Casull |

(Continued)

FOREIGN PATENT DOCUMENTS

| | | | |
|---|---|---|---|
| GB | 2207493 | A | 2/1989 |

*Primary Examiner* — Stephen Johnson

(74) *Attorney, Agent, or Firm* — Pedersen & Company, PLLC; Ken J. Pedersen; Barbara S. Pedersen

(57) ABSTRACT

Components of a firearm having a bolt with locking lugs improve shooting accuracy, due to increased coaxial alignment between the bolt, the cartridge, the receiver, and/or the barrel of a firearm. The receiver inner surface is shaped for lug-cleaning and for close tolerance/mating with the lugs only in the locked position and also with a non-threaded, axial surface of the barrel. Thus, the mating surfaces that are instrumental and/or that mainly control coaxial alignment of the receiver, bolt, and barrel are located between the lug stops and the threaded end of the receiver. The lugs may be axially curved or otherwise axially non-linear to tolerate dirt and other debris in a field environment.

22 Claims, 20 Drawing Sheets

(56) References Cited

U.S. PATENT DOCUMENTS

| | | | | |
|---|---|---|---|---|
| 6,000,161 | A * | 12/1999 | Aalto | F41A 3/18 42/16 |
| 6,209,249 | B1 | 4/2001 | Borden | |
| 7,219,461 | B1 | 5/2007 | Keeney et al. | |
| 7,975,417 | B2 | 7/2011 | Duplessis et al. | |
| 8,302,340 | B1 * | 11/2012 | Irwin | F41A 3/22 42/16 |
| 8,375,616 | B2 | 2/2013 | Gomez et al. | |
| 8,701,326 | B2 | 4/2014 | Zonshine | |
| 8,782,939 | B2 | 7/2014 | Constant et al. | |
| 8,844,182 | B2 | 9/2014 | Ibarguren | |
| 8,925,230 | B2 | 1/2015 | Warburton et al. | |
| 9,010,009 | B2 | 4/2015 | Buxton | |
| 9,057,572 | B2 | 6/2015 | Matteson | |
| 9,151,553 | B2 | 10/2015 | Constant et al. | |
| 10,132,579 | B2 * | 11/2018 | Schenker | F41A 3/22 |
| 2012/0311908 | A1 * | 12/2012 | Kenney | F41A 21/482 42/75.02 |
| 2014/0075807 | A1 | 3/2014 | Lewis | |
| 2014/0115938 | A1 | 5/2014 | Jarboe | |
| 2014/0196347 | A1 | 7/2014 | Komatsu et al. | |
| 2016/0054096 | A1 | 2/2016 | Dzwill | |
| 2016/0252314 | A1 * | 9/2016 | Mather | F41A 3/22 42/16 |
| 2018/0128567 | A1 | 5/2018 | Foster et al. | |

* cited by examiner

FIREARM WITH LOCKING LUG BOLT, AND COMPONENTS THEREOF, FOR ACCURATE FIELD SHOOTING

This application is a continuation of Ser. No. 15/047,569, filed Feb. 18, 2016, and issuing on Nov. 20, 2018 as patent Ser. No. 10/132,579, the entire disclosure of which is incorporated herein by this reference.

BACKGROUND OF THE DISCLOSED TECHNOLOGY

Field of the Disclosed Technology

This invention relates generally to firearms comprising a bolt having locking lugs. More particularly, this invention relates to improvements in coaxial alignment of components of such a firearm, and preferably also limiting the effect of rain, water, freezing water, snow, ice, dirt, vegetation, and/or other elements entering the firearm in a field environment, for example, during target shooting, hunting, or combat in inclement, uncontrolled, or unclean environments.

Background/Related Art

Firearms having an action comprising a bolt with locking lugs are well-known and may feature different types of bolt actuation, for example, bolt-handle action, lever action, pump action, automatic action, and semi-automatic action. Conventionally, there has been a compromise in the design of such firearms between accuracy and tolerance to elements that may enter and interfere with the firearm action. A key to accuracy is to have the bullet travel straight down the firearm barrel and exit the muzzle pointing the same direction the barrel was pointed when the trigger was pulled. One or more misalignments may be responsible for inaccuracy in bullet travel, for example, misalignment of the cartridge in the chamber, misalignment of the barrel bore relative to the bolt and/or receiver, and/or axial-misalignment of threads or an inaccurately-cut radial receiver face for connection of the barrel to the receiver. A combination of multiple of these misalignments tends to create an inaccurate firearm, especially in field firearms that are made with loose tolerances to allow movement and cycling of the action in spite of interference by elements present in outdoor or other non-controlled/non-clean environments. For example, for precision rifle shooting, compromise in rifle design typically makes a rifle either more accurate but less usable in the field (a "benchrest rifle"), or more usable and tolerant to dirt and weather but not as accurate (a "field rifle").

Benchrest rifles have such tight tolerances that they don't work well with dirt and weather encountered in the field and require frequent cleaning after only one or a few rounds are fired, but they are consistently more accurate. Additionally, benchrest rifles are usually impractical in the field due to their weight. The components of benchrest rifles are built heavier to resist flexing that causes harmonic vibrations, which can cause inaccuracy. For example, benchrest barrels are built heavier to reduce barrel whip when the round is fired.

Field rifles have relatively loose tolerances between moving components, because loose tolerances allow ice and dirt to be present without limiting operability of the action, and also permit less expensive manufacture. Field rifles, with thinner components and barrels, are also much lighter for being carried about in rough field terrain.

The patent literature illustrates attempts to increase accuracy of bolt-action firearms. U.S. Pat. No. 6,209,249 Borden discloses a bolt for a firearm with increased accuracy. The bolt body has front and rear exterior bosses with diameters slightly larger than the rest of the bolt body, resulting in a tighter tolerance between portions of the bolt and the bolt runway in the regions of the bosses. U.S. Pat. No. 7,975,417 Duplessis et al. discloses joining a barrel to the receiver of a bolt-action rifle with a threaded insert. The Duplessis, et al. threaded insert may be considered a separate, trunnion piece that helps set the rifle headspace, to offset/account for barrel machining error, and that helps with barrel interchangeability.

Custom rifle manufacturers have made some improvements, or have pushed the boundaries of turning a conventional field rifle into a more accurate long-range rifle, by reducing the tolerances between the bolt body and the bolt bore of the receiver of the rifle thereby reducing bolt and cartridge misalignment. Instead of the approximately 0.015 (fifteen thousandths) inch clearance between the bolt and the receiver in many field rifles of the past, these custom manufacturers often make the clearance approximately 0.005 (five thousandths) inch. Reducing this clearance makes the bolt better aligned with the receiver. This compromise, however, makes the rifle action more susceptible than a field rifle to binding and blockage from outdoor interferences such as dirt and ice, and makes the rifle still not as accurate as a benchrest gun that often has approximately 0.0005 (five ten-thousandths) inch clearance.

A BORDEN™ rifle action has very tight tolerances between the receiver and the bolt bosses that are behind the bolt lugs, specifically, approximately 0.0005 (five ten-thousandths) inch, starting from when the bolt starts to enter lock up (the beginning of the rotation), all through the approximate 90 degree rotational turn into the "locked-up" (also, "battery") position. The bolt bosses are what have been called "BORDEN™ bumps", which are in the bolt body that lie behind (proximal to) the bolt lugs and in front of (distal to) the bolt handle. These bosses have a larger maximum diameter than the bolt body, serving the purpose of reducing clearance between the bolt and the receiver bore in the location of the bosses. Such bosses, however, are behind (proximal to) the bolt lugs, and are susceptible to binding and blockage when outdoor interferences such as dirt and ice enter between the bolt bosses and the receiver bore. Thus, the BORDEN design relies on precise manufacture of the portions of the bolt main body and the receiver that are behind (proximal to) the bolt lugs and behind (proximal to) the lug abutments/stops, respectively. That is, the BORDEN design relies on precise manufacture of structure/surfaces that are separate, and distant, from the bolt lugs, bolt distal face, and the barrel threaded connection to the receiver.

Therefore, there is still a need to provide more shooting accuracy in a "field-capable" firearm that has an action comprising a bolt with locking lugs. Therefore, an object of certain embodiments is to improve axial alignment of the bolt, cartridge, receiver, and barrel, of such a firearm, for increased shooting accuracy. An object of certain embodiments is to accomplish said improved axial alignment by specially-adapting the distal end of the receiver forward of the lug stops, and preferably also the distal end of the bolt at the lugs and the proximal end of the barrel where it connects to the distal end of the receiver. An object of certain embodiments is to accomplish said axial alignment by having the lugs when in their locked condition, and also a barrel axial surface, mate with the same surface, for example, with adjacent portions of the same surface. An object of certain embodiments is to achieve said improved axial alignment while achieving consistent operability of said axial alignment in the adverse conditions experienced in field environments, including outdoor hunting and combat environments, and other non-pristine environments/conditions. An object of certain embodiments is to provide a firearm that shoots with near-benchrest accuracy, but that tolerates build-up of dirt, ice, water, or other interfering elements on moving parts, without undue binding or blockage and the resulting excessive mechanical failure of the moving parts. An object of certain embodiments is to accomplish said tolerance of interfering elements by means of the lug having a debris-cleaning/scraping capability. An object of certain embodiments is to achieve said improved axial alignment by means and methods that also reduce machining steps and also reduce or eliminate hand-tooling and customizing of the shape and length of each rifle barrel firing chamber/head-space. An object of certain embodiments is to provide a field-capable firearm that is accurate in spite of imperfections in the firing chamber/headspace shape or surfaces and in the cartridge casings, and/or the imperfections from fouling of the firing chamber/headspace surfaces that are intended to align the distal shoulder of the casing. Certain embodiments of the invention meet or exceed one or more of these objects, as will be further understood from the following discussion.

SUMMARY

Components of a firearm having a bolt with locking lugs are adapted for improved accuracy. At least one adaptation in the components for improving accuracy provides increased coaxial alignment between the bolt, the cartridge, the receiver, and/or the barrel of a firearm, for example, including firearms typically considered field firearms or firearms typically considered benchrest firearms. Said at least one adaptation preferably comprises adaptation of the receiver inner surface for close tolerance/mating with the lugs while only in the locked position. The interaction of the bolt locking lugs with said receiver inner surface may provide a cleaning capability, for enhancing tolerance of the firearm action to interfering elements. Said at least one adaptation may comprise a shape/contour of the lug circumferential outer surface that enhances said cleaning capability and element tolerance. Said at least one adaptation may comprise said receiver inner surface being in a close tolerance/mating relationship with a non-threaded, axial surface of the barrel.

Coaxial alignment of the bolt and the bolt distal face in the receiver bore/boltway is accomplished in a way that prevents interference by debris, such as dirt, ice, or water, from unduly interfering with critical moving parts of the bolt. Preferably, when rotating from the unlocked to the locked position, the bolt lugs move from areas within the receiver where relatively larger spaces exist between the lugs and the receiver, to areas where relatively smaller spaces exist between the lugs and the receiver. This is preferably done by making a distal portion of the receiver bore/boltway not exactly cylindrical, for example, by forming ramps on the interior surface of the receiver lug space. When the bolt rotates into the locked ("battery") position, the bolt lugs move from loose tolerance areas that provide room for debris accumulation, along transition areas of the ramps that clean/scrape debris from the lugs, to very tight tolerance areas of the ramps where the lugs mate with the receiver.

Further coaxial alignment of the firearm components may be accomplished by providing an extension on the barrel that mates, around at least a portion of the circumference of the barrel, with at least a portion of the inner surface of the receiver. Preferably, this is done by providing an axial, non-threaded extension that protrudes proximally beyond the threaded region of the barrel to mate with the axial, receiver inner surface with which the lugs mate when locked. Said mating of the non-threaded extension results in significantly more precise and exact coaxial alignment of the barrel bore with the receiver bore/boltway and the locked bolt, compared to the misalignment caused by the mandatory thread clearances in a threaded barrel connection.

In preferred embodiments, therefore, a single surface provides the ramps/surfaces both for mating with the bolt lugs only during lock-up, and for mating with the barrel extension. This single surface is at least a portion of the receiver inner surface forward (distal) of the lug stops and rearward (proximal) of the receiver threads. For example, when the receiver inner surface is ramped from the lug stops to the threads of the receiver, then the bolt lugs mate with proximal regions of the ramp crests, and the barrel extension mates with distal regions of the crests. Alternatively, when the receiver inner surface is ramped near the lug stops, but is another shape near the receiver threads, then the bolt lugs mate with the crests near the lug stops, and the barrel extension mates with one or more regions of, or the entire, said another shape near the receiver threads. In certain embodiments, said "another shape" may comprise, consist essentially of, or consist of, the crest surface(s) extending distally past the lugs and into the barrel-extension-receiving space, so that a barrel extension mating with said distally-extending crest surface(s) would be mating with "the same surface" with which the lugs mate in the locked position. Thus, it is preferred that troughs are provided in the receiver inner surface near the lug stops, to provide more clearance for debris entering the receiver that might otherwise interfere with the rotating bolt, but said debris-receiving troughs are not necessarily required where the installed barrel extension resides, because it does not move during operation and debris at the installed barrel is not a significant concern. Said mating with the same surface, and the distal location of said same surface in the action, simplifies and/or makes more accurate and precise, the machining step(s) for the firearm action.

Additionally or instead, certain embodiments of the bolt lugs outermost surfaces comprise axial curvature, and/or other axial non-linearity, for reducing the surface area of said outermost surfaces that mates with the receiver inner surface in the locked position. Said axial curvature or non-linearity provides at least one region of maximum lug diameter and at least one region of lug diameter that is smaller compared to said maximum lug diameter. In the case of axial curvature, each lug preferably curves in an axial direction between a single maximum lug diameter and one or more end edges that are reduced in diameter; this places the maximum lug diameter region relatively close to the receiver inner surface, and the rest of the outermost surface of each lug relatively distant from the receiver inner surface. In the case of other non-linearity, each lug may comprise ridges and recesses in said outermost surface. Thus, due to said axial curvature or other axial non-linearity, only a small surface area of the lugs mates, when the lugs are rotated to the locked position, in very tight tolerance with the minimum-diameter portions (crests) of the ramps of the receiver inner surface.

Therefore, certain embodiments align the bolt, receiver, and barrel of the firearm in a coaxial and concentric configuration by providing surfaces of tighter tolerances distal of the lug stops and close to the chamber, for mating with the locked lugs and for mating with the barrel, while providing looser tolerances for the bolt during axial travel, and prior to lock-up, to allow for satisfactory field operability. Certain of these embodiments minimize the number of separate machining steps, and minimize or eliminate the custom/hand-work, needed to build the various portions of the action and chamber, in order to provide more economical manufacture, with fewer alignment errors.

DETAILED DESCRIPTION OF CERTAIN EMBODIMENTS

Additional Background

Figure 1:
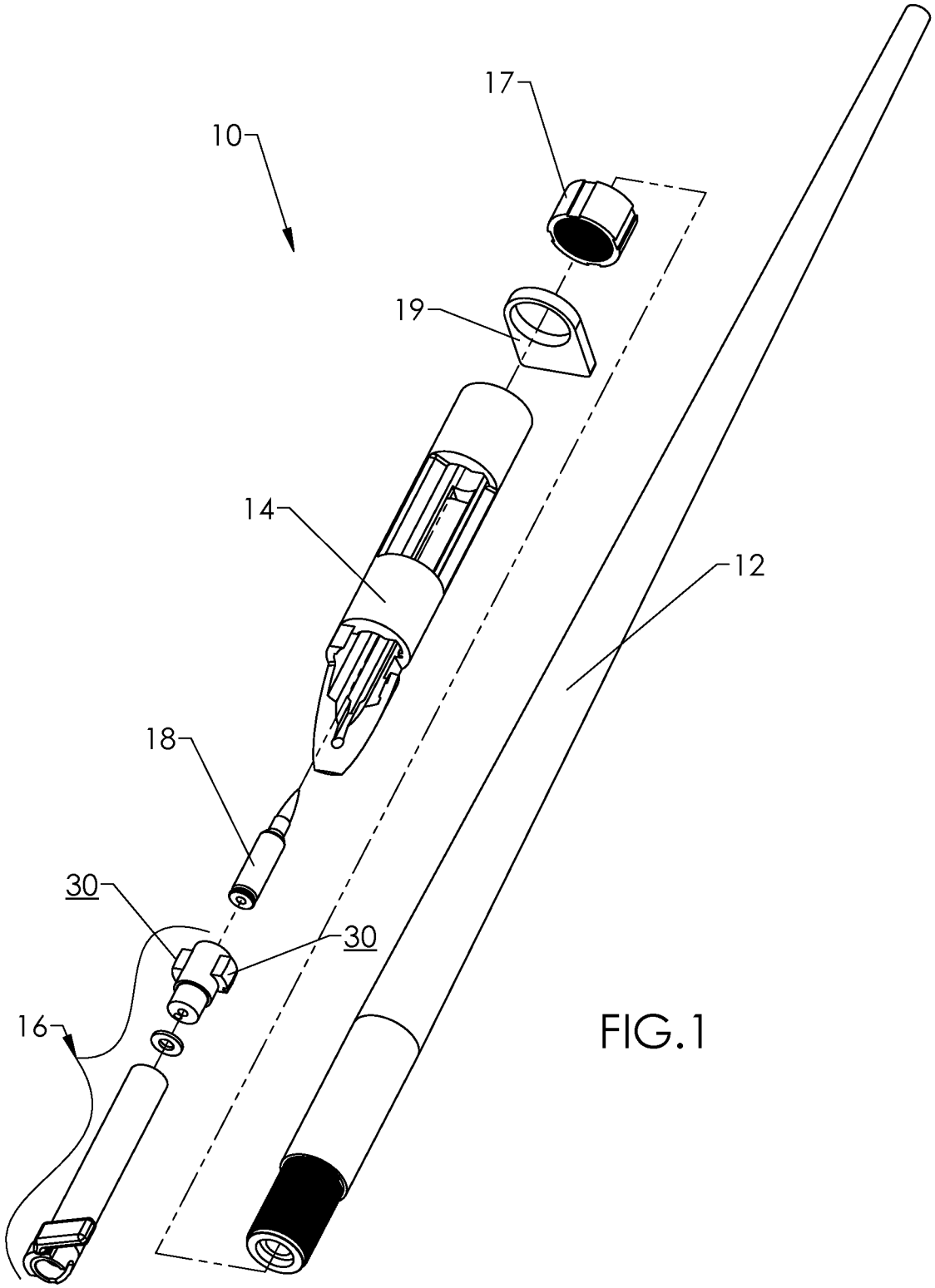
FIG. 1 is an exploded, top perspective view of one embodiment of adapted bolt, receiver, and barrel components for a right-handed bolt action rifle, according to the disclosed technology.

Regarding Function of a Bolt Action Rifle:

Components and operation of a bolt action rifle are shown in the drawings and detailed in this document as an example of one type of firearm/action that may comprise one or more of the adaptations disclosed herein.

When a bolt handle is lifted, usually 60-90 degrees (depending on design) from the "locked" or "battery" position, the bolt moves to extract and eject any spent cartridge and moves into the unlocked/cocked position in which a firing pin is spring loaded in a position ready to strike a primer on the next cartridge case to be fired. The bolt in this unlocked position is enabled to move rearwardly in the boltway to collect and engage a new cartridge, so that, when the bolt is then pushed forward, it forces the new cartridge into the firing chamber. Then the bolt can be rotated, by rotating the bolt handle downwards, into the locked position. In this position, the rifle is ready to have the trigger pulled, which releases the firing pin, igniting the primer and detonating the gunpowder in the cartridge. Upon firing, the bullet then leaves the cartridge, moving along and out the barrel, pushed by the expanding gases from the detonation of the powder in the cartridge in the chamber.

Regarding Tight/Loose Tolerances/Clearance:

Tolerances refer to the clearance between different parts. For example, a bolt and receiver surface clearance of 0.0005" (5 ten-thousandths of an inch) has a tighter tolerance/clearance than a bolt and receiver surface tolerance/clearance that is 0.005" (5 thousandths of an inch). Herein, when the tolerance/clearance is very small/tight, it may be said that the two surfaces are "mated", as they are extremely close or even touching.

Barrel:

A cylindrical tube containing spiral lands and grooves through which the projectile of the cartridge, or "bullet", is designed to travel with a deformed press fit after obturation of the bullet into the grooves upon detonation of the cartridge. The lands and grooves spiral within the barrel guide the bullet in a spiral rotation as it leaves the barrel, thereby imparting axial spin to the bullet.

Axial:

The term "axial" means of, relating to, or having the characteristics of, an axis, and in this context, the longitudinal axis of the receiver, bolt, barrel and/or cartridge. Thus, the longitudinal axis of each of these elements will tend to run end-to-end centered in the structure and particularly centered in the bore through the element in which the cartridge moves during loading (receiver bore and the barrel chamber), or the bullet travels upon firing (barrel bore).

Axially Aligned Rifle:

A rifle wherein, as is the object of certain embodiments of the disclosed technology, the barrel, bolt, and receiver of the rifle are all aligned with their central longitudinal axes on the same axis or "longitudinal centerline". As these components are cylindrical in nature, each has an axial dimension(s) and a radial dimension(s), and making the components coaxial (axially aligned) will also make them concentric. Arranging these components in this axially aligned manner, according to certain embodiments of the disclosed technology, will also place a loaded rifle cartridge, which also is cylindrical in nature, also in an axially aligned orientation, and will provide a straighter axial path for the bullet of the cartridge fired from such a rifle.

Accuracy:

Accuracy in this context means a shot consistently impacting a target in close proximity to prior shots with no change in point of aim, given consistent environmental conditions Firing Chamber:

A space/interior volume that is generally and substantially a duplicate or negative/opposite form of the cartridge, the firing chamber being cut into the proximal bore of the barrel, ideally in axial alignment with the barrel for receiving the loaded cartridge. Hand-tooling/adjustment of the chamber surfaces may be required in many conventional rifles in order to improve the chamber's ability to hold the cartridge in coaxial relationship with the barrel bore.

Benchrest Rifles:

Benchrest rifles are relatively heavy, precisely and rigidly-built rifles, that shoot in controlled environments where little or no debris, such as dirt, ice or water, or temperature variations, are present, for example, wherein the shooters sit at benches, covered by roofs, and have the opportunity to meticulously clean their weapons. The components of these rifles utilize such tight tolerances between moving parts that they do not function well if used in inclement weather or in an uncontrolled/dirty environment. Benchrest rifles typically utilize precisely shaped, measured and weighed cartridge ammunition for the intent of reducing variables that may cause inaccuracy. Benchrest rifles are impractical to use in hunting or other outdoor environments where said debris or temperature variations are present to cause problems with mechanical function of the rifle.

Field Rifle:

A relatively lightweight rifle that is conventionally not accurate at long ranges, and which incorporates more loosely-fitting components (looser or larger tolerances) that will operate better in dirty, wet, or freezing conditions. The components of a field rifle are loosely fitted to minimize costs and maximize operability in rough conditions that occur during field conditions. The term "field" herein means a natural or uncontrolled environment, for example, outdoor shooting, hunting, or combat without a roof or other shelter, where rain, water, freezing water, snow, ice, dirt, vegetation, temperature variations, and/or other elements may enter or otherwise adversely impact functionality of the firearm.

Receiver:

A receiver of a rifle is conventionally a cylindrical body that has a cylindrical bore through the middle of it. A receiver usually has two or three parallel paths, or action pathways, cut out of the bore that guide the bolt down the centerline of the receiver, towards the firing chamber end, or distal end, of the receiver. In a receiver there are usually two or three lug abutments (herein, "lug stops", but also sometimes called "integral lugs") that prevent the bolt from blowing backwards when the gun is fired. This is accomplished when the bolt is rotated or "cammed over" by the bolt handle into the locked position, so that each bolt lug aligns in front of a corresponding lug stop.

Bolt:

The bolt of a rifle is a generally cylindrical rod-like structure with a handle at the back, and locking lugs (herein also simply "lugs") at the front (breech or firing chamber end), so that, when the bolt is inserted into the action, the bolt lugs ride in the action raceways and the bolt body (cylindrical tube part) aligns with the action bore. The lugs of the bolt, when rotated with the handle, align in front of the lug stops.

Bolt Lugs:

The bolt lugs are protrusions from the bolt body, spaced circumferentially around the bolt, that engage with the lug abutments (also, herein, "lug stops") to prevent the bolt from moving rearward during discharge. Most conventional bolts have 2-8 lugs, and typically 2-4.

Lug Abutments:

Lug abutments, also called "lug stops" herein, are metal pieces in the receiver that lie perpendicular to the receiver bore which prevent the bolt from moving backwards when the rifle is fired. The bolt is slid forward in an orientation that allows the bolt lugs to pass by/between the lug abutments, and then, upon rotation by the bolt handle into the locked position, the bolt lugs are directly distal of the lug abutments so that the lug abutments prevent the lugs from being forced backward upon firing.

Barrel Whip:

Whip is the up, down, and sideways plane barrel movement when the rifle is fired, caused by high pressures in the rifle when a bullet is forced distally through the barrel under extreme pressure upon ignition of the cartridge. Barrel whip occurs upon firing, because the bullet is thrust out of the casing to travel distally through the barrel. While the bullet has a press-fit, relatively tight fit with the barrel once it leaves the casing, the roughly 50,000 psi of pressure of the firing explosion causes barrel movement or whip based on the harmonics of the barrel. If the bullet is misaligned (canted any direction off of the longitudinal axis of the barrel), a slight ricochet effect distally along the barrel may occur and the barrel whip is made more erratic. Erratic barrel whip points the bullet in a different direction each time the bullet leaves the barrel. Some barrel whip is normal and unavoidable, given the pressures involved, but it is advantageous for accuracy to reduce the magnitude and make the barrel oscillations more consistent and repeatable by minimizing or eliminating the "ricochet effect".

Ammunition/Cartridge:

Cartridges are the ammunition used in a rifle, comprising a generally cylindrical case, primer to ignite the powder charge, gun powder charge, and bullet or projectile. The case encloses the gun powder and primer to ignite the powder, and, upon ignition, to push a bullet/projectile distally along and out of the barrel.

Harmonics:

Harmonics are the vibrations or movement of an object in three dimensional space. For rifles, the harmonics are shock waves, emanating throughout the firearm upon ignition and explosion of the powder charge, that create barrel whip movement.

Bolt Canting:

Where the centerline of the bolt is on a different axis from the centerline (central axis) of the action and/or the barrel, that is, a condition where the bolt is not coaxial with the receiver and/or the barrel.

Lug Rotation Space:

Lug rotation space, also "lug space" herein, means the volume, distal of the lug stops and proximal of the receiver threads for connection to the barrel. The bolt lugs enter the lug rotation space when loading the cartridge into the chamber, and the bolt lugs rotate in the lug rotation space to lock into the locked position. In conventional field rifles, there is significant clearance in the lug rotation space between the entire cylindrical inner diameter of the receiver and the bolt lugs outer diameter.

Barrel Proximal End:

Conventionally, the barrel comprises a threaded, male, proximal end that is screwed into the female threaded distal end of the receiver.

General Discussion of the Drawings

As illustrated by the exemplary embodiments of the Figures, preferred embodiments of the disclosed technology have the bolt and barrel align in a coaxial and concentric configuration with the receiver, by being indexed off of the same distal, axial receiver surface, using very tight tolerances in certain regions and/or at certain times during operation, for improved shooting accuracy, while also using looser-tolerances in other regions and/or at certain times during operation, to allow for the debris and/or temperature variation of field environments. In preferred embodiments, non-threaded regions of axial surfaces of each of the receiver and the barrel mate, and a portion of the bolt lugs mate at certain time(s) during operation with another non-threaded region of the same axial surface of the receiver, to provide a coaxial and concentric configuration of all of the receiver, barrel, and bolt. Having "the same surface" or "a single surface" mate with both lugs and barrel reduces compounded machining variations, for example, that occur when mating multiple critical parts off of several different and distantly-located surfaces that all have different machining tolerances. Further, in preferred embodiments, the bolt lugs are curved or otherwise non-linear in the axial direction, to provide a smaller contact area of very tight tolerance during bolt lock-up so that the lugs are not prone to bonding or blockage.

An object of the preferred adaptations is to make the firearm consistently accurate by having the bullet exit the barrel pointing exactly or nearly exactly the same direction each time the rifle is shot. To accomplish this, multiple components of the rifle action are co-axially aligned, that is, preferably all of the barrel bore longitudinal axis, the receiver distal space longitudinal axis, and the bolt distal face longitudinal axis are coaxially-aligned with each other for consistent accuracy. The "longitudinal axis" of each of these components may also be referred to as the "longitudinal centerline" or the "central axis". Preferably, all the bolt lugs are made accurately and precisely to extend the same radial distance from the longitudinal axis of the bolt, and the bolt lugs are locked against an inner surface of a distal portion of the receiver. The bolt distal face, which holds the proximal end of the cartridge is radially-centered between the outermost extremities of the bolt lugs, and has a center that is on the longitudinal axis of the bolt; hence, the distal face is coaxial with the longitudinal axis of said distal portion. Preferably, the barrel is also mated with said inner surface of the distal portion. These relationships result in the bolt distal face being centered and coaxial with the barrel bore, and therefore being capable of aligning the proximal end of the cartridge with the longitudinal axis of the barrel. It may be noted that all of these coaxial features, and the resulting coaxial alignment, are established in distal areas of the action that are very close to the cartridge in the breech and are therefore very critical for accuracy. Said coaxial features, therefore, place and maintain the cartridge in the chamber consistently coaxially-aligned with the barrel bore prior to firing, which increases accuracy.

All of the above-mentioned co-axial features are preferred, because the lack of any one of the co-axial features may result in a loss of accuracy, for example, due to excessive barrel whip when the gun is fired, or even incomplete/inconsistent closure of the bolt or the force of the firing pin and/or ejector spring of the firearm as further described below.

The incomplete or inconsistent bolt closure can occur because the bolt is closed by hand, and it may not be closed in exactly the same position every time. It may be closed in 90-100% of its rotational position and still fire. It also can be forced up or down, left or right, depending on the motion that the shooter's hand pushes the bolt handle on closure, with the variance being more drastic if clearances are large. However, if the components of the action are on the same central axis/centerline with tight tolerances in certain areas and/or steps of operation as in the preferred embodiments, then the aligned rifle should be more accurate even if the closure of the bolt is not 100% and/or the percentage closure of the bolt is different each time.

The force of the firing pin, held by the trigger sear, may also misalign the bolt; as this force tends to push the back of the bolt upward, canting the bolt and therefore the bolt face out of alignment. Also, pressure from the ejector spring, when the bolt is locked, puts force against one side of the cartridge, which tends to cant the bolt and also the cartridge out of alignment.

Aligning/indexing all the rifle components that are critical for axial alignment of the cartridge and bullet, namely the barrel, bolt and receiver, off of one machined surface reduces inevitable machining error from aligning off of several different surfaces. Said one surface is preferably an interior, not-exactly-cylindrical surface of the receiver distal of the lug stops, in order to improve field operability. To accomplish said alignment/indexing, the outermost surfaces of the bolt lugs mate with a more proximal region of said one surface, while a proximal non-threaded extension (hereafter called "tenon" or "tenon portion") of the barrel mates with a more distal region of said one surface. By providing coaxial alignment of components/surfaces very close to the location of the cartridge in the chamber, as in the preferred embodiments, the risk of machining error is reduced compared to the conventional technique of separate machining of different, distant surfaces to try to form good alignment in the rifle action.

Said mating of the barrel to said one surface significantly reduces "axial play" of the barrel relative to the receiver bore and the bolt distal face. This barrel connection may be contrasted to conventional connection of the barrel to the receiver by threads alone, wherein the necessary clearance in threads, to prevent binding when the barrel is screwed into the receiver, results in a lot of "axial play" of the barrel relative to the receiver bore and the bolt distal face.

The mating of the lugs with said one, preferably non-exactly-cylindrical, surface is preferably done by providing tight clearance between one or more portions of the bolt lugs in the "lug space" during only a portion of the bolt lock-up path. Preferably, this is accomplished by providing the inner surface of the receiver with ramps. The ramping of the receiver inner surface allows the lugs to enter the lug space in an area(s) of high clearance between the lugs and the receiver, and then to rotate to an area(s) of low clearance for lock-up of the bolt/lugs. This high clearance area is used for receiving the bolt lugs as the bolt is pushed forward into distal region of the receiver, and likewise, for receiving the bolt lugs just prior to the bolt being pulled rearward from the distal region of the receiver. For example, the preferred high clearance between each lug and the receiver inner surface in the loaded but unlocked condition is greater than or equal to 0.010 inches.

During rotation to the locked condition, each bolt lug rotates from the high tolerance areas, that is, larger diameter regions ("troughs", "trough surfaces", or "trough regions" of the ramped surface) to low tolerance areas, that is, minimum receiver bore diameter regions ("crests", "crest surfaces", or "crest regions" of the ramped surface). This decreases the clearance between the bolt lugs and the receiver bore, so that, when in fully-locked position, clearance between the maximum-diameter portions of the bolt lugs and receiver bore surface will be very small, for many caliber field firearms preferably less than 0.004 inches (for example, 0.0039, 0.002, 0.001, 0.0008, or most preferably 0.0005-0.0003 inches, or alternatively any number of inches or ranges between these values).

Therefore, this relatively very tight tolerance, low clearance condition occurs only when accuracy is critical, that is, in/during the locked position, in order to provide coaxial alignment of the bolt and its lugs with the receiver. To further help clear, and prevent binding or blockage by, debris in the action, the bolt lugs outermost surface is adapted to not be exactly the same shape as the minimum receiver bore diameter. This is done by giving said outermost surface of each lug axial curvature or other axial non-linearity, so that the outermost surface of each lug is not only circumferentially/radially curved, but also curved/non-linear in the axial direction. This results in only a relatively small surface area, at the minimum receiver bore diameter, being close to the receiver inner surface. For example, this results in a narrow area or "line" of material, extending circumferentially at the largest radius/diameter of each lug, which is the portion of the outermost surface closest to the receiver inner surface at all times that the lugs are in the lug space (unlocked or locked). Portions of the outermost surface, other than said narrow area or "line" of material, will be farther away from the receiver bore surface at all times that the lugs are in the lug space (unlocked or locked). The maximum lug radius/diameter, and therefore said narrow area or line of surface area, is preferably but not necessarily in all embodiments, midway between the distal edge and proximal edge of the lug. Alternatively, other axial non-linearities in the outermost surface of the lugs may be provided to minimize the contact surface area of each lug in the locked condition, for example, ridges and recesses in said outermost surfaces that provide more than one relatively large diameter and more than one reduced diameter along the axial length of each lug.

The distal and proximal edges, or other recessed non-linearities, of each lug will be farther away from the receiver bore surface than the largest-diameter(s) of each lug. For example, when the bolt and its lugs are in the unlocked position, that is, in the high clearance position, the largest-diameter of each lug is greater than or equal to 0.010 inches from the receiver inner surface, and the smallest-diameter(s) of each lug is 2-5 times farther from said receiver inner surface than is the largest-diameter(s). For example, when the bolt and its lugs are in the locked position, the largest-diameter of each lug is less than 0.004 inches (for example, 0.0039, 0.002, 0.001, 0.0008, or most preferably 0.0005-0.0003 inches, or alternatively any number of inches or ranges between these values) from the receiver inner surface, and the smallest-diameter(s) of each lug is 2-5 times farther from said receiver inner surface than is the largest-diameter(s). One may note from these exemplary clearances of the maximum diameter of the lug, that is, less than 0.004 inches (from the crest) in the locked position and at least 0.010 inches (from the trough) in the unlocked position, that the exemplary ramps may extend radially inward to form a diameter of at least 0.006 inches smaller than the diameter formed by the troughs. Therefore, while the entire outermost surface area of each lug may be, for example, in the range of about 0.25-1.0 square inches, said narrow area or line of surface area mating with the receiver minimum diameter may be less than 20 percent (for example, less than 0.2 square inches or less than 0.05 inches), of said entire outer surface area, due to the axial curvature or other axial non-linearity of the lug. Or, for example, said narrow area or line of surface area mating with the receiver minimum diameter may be less than 10 percent (for example, less than 0.1 square inches or less than 0.025 inches), of said entire outer surface area, due to the axial curvature of the lug.

Part of the synergy of the preferred lug and receiver design is that, when the bolt is being opened or closed, any debris will more likely be scraped or otherwise forced away from the largest-diameter(s) regions of the lugs to the smaller-diameter regions of the lugs, and away from the crests of the receiver inner surface, into the non-critical high clearance portions of the receiver bore diameter (the troughs). In other words, as the bolt is opened and closed (moved in and out of locked position), there is a cleaning/scraping action due to the relative motion of the lugs and the receiver, for moving dirt and ice out of the way into the lug recesses and/or receiver troughs. Only during a small portion of the rotation of the bolt into locked position, that is, the end of the rotation, will the bolt and receiver minimum bore possibly be more susceptible to bonding or blockage, but the scraping action provided by the ramped contour of the receiver inner surface will minimize or eliminate this possibility. Additionally, even if the bolt lugs are not fully rotated into the fully-locked position (not fully rotated to the center of the crests) due to debris blockage or operator execution, said ramped contour, and especially the transition areas between the crests and the troughs, tends to center the not-fully-rotated lugs and bolt, in a more-coaxial alignment than if the ramped contour were not present, due to the decreasing diameter of the transition areas relative to the troughs.

Referring Specifically to the Drawings

FIGS. 1 through 25 illustrate embodiments featuring multiple of the preferred adaptations in the rifle action, according to the disclosed technology, for improved accuracy while maintaining weather-, dirt-, and ice-tolerance for acceptable field operation of the rifle. The embodiments in FIGS. 1-25 comprise all three of the preferred adaptations (that is, adaptation in the receiver, the bolt, and the barrel), because this is expected to provide the most superior shooting accuracy, but other embodiments may comprise one or more, but not all, of the adaptations, for example, one or two of the adaptations.

Figure 10:
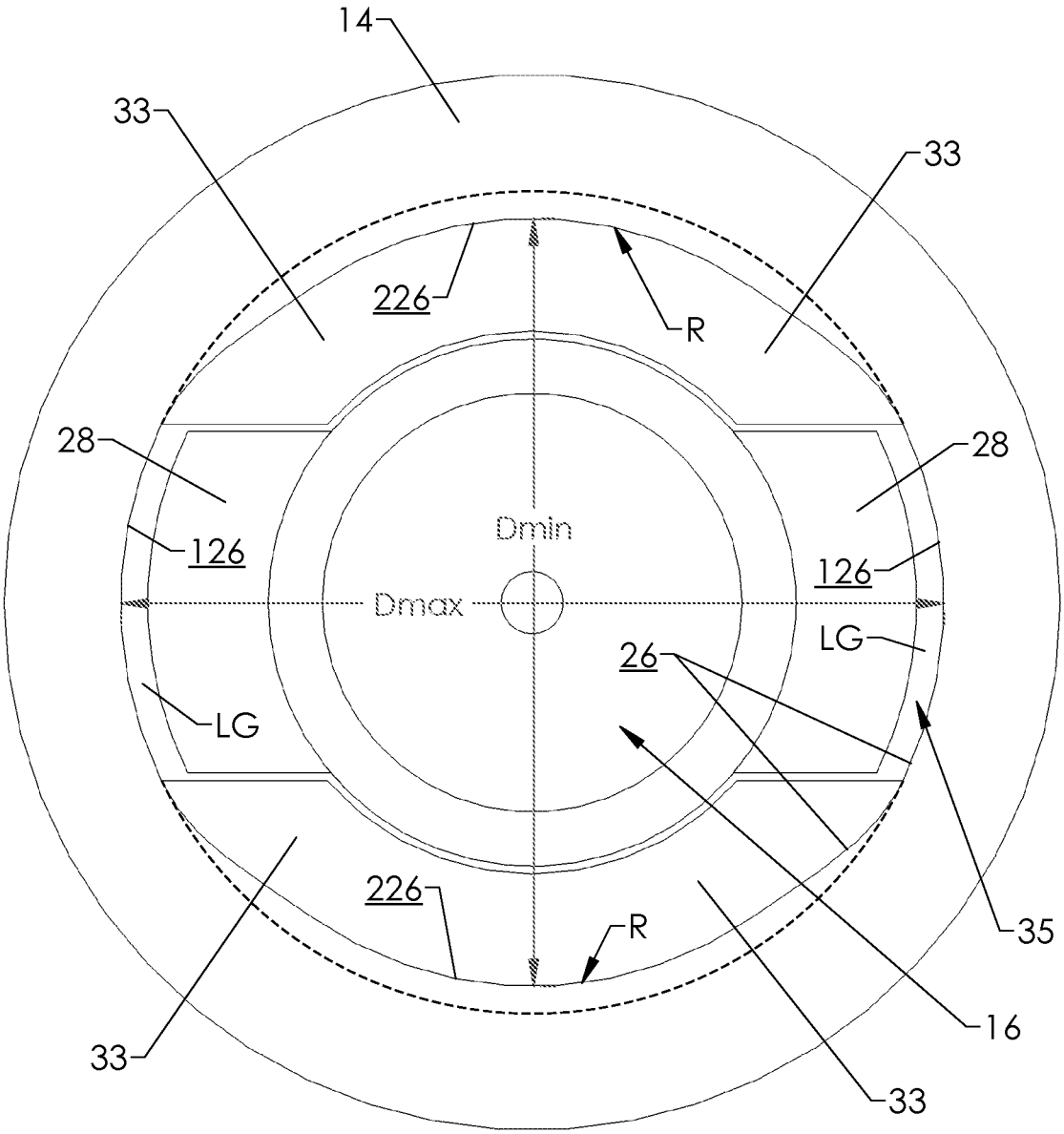
FIG. 10 is a schematic distal end view of the bolt pushed forward in the receiver to the loaded but unlocked position of FIGS. 2-9, wherein the lugs are distal of the lug stops in the lug rotation space, at/adjacent the troughs of the ramps (exaggerated for illustration) on the inner surface of the receiver, in a loose tolerance condition.
Figure 11A:
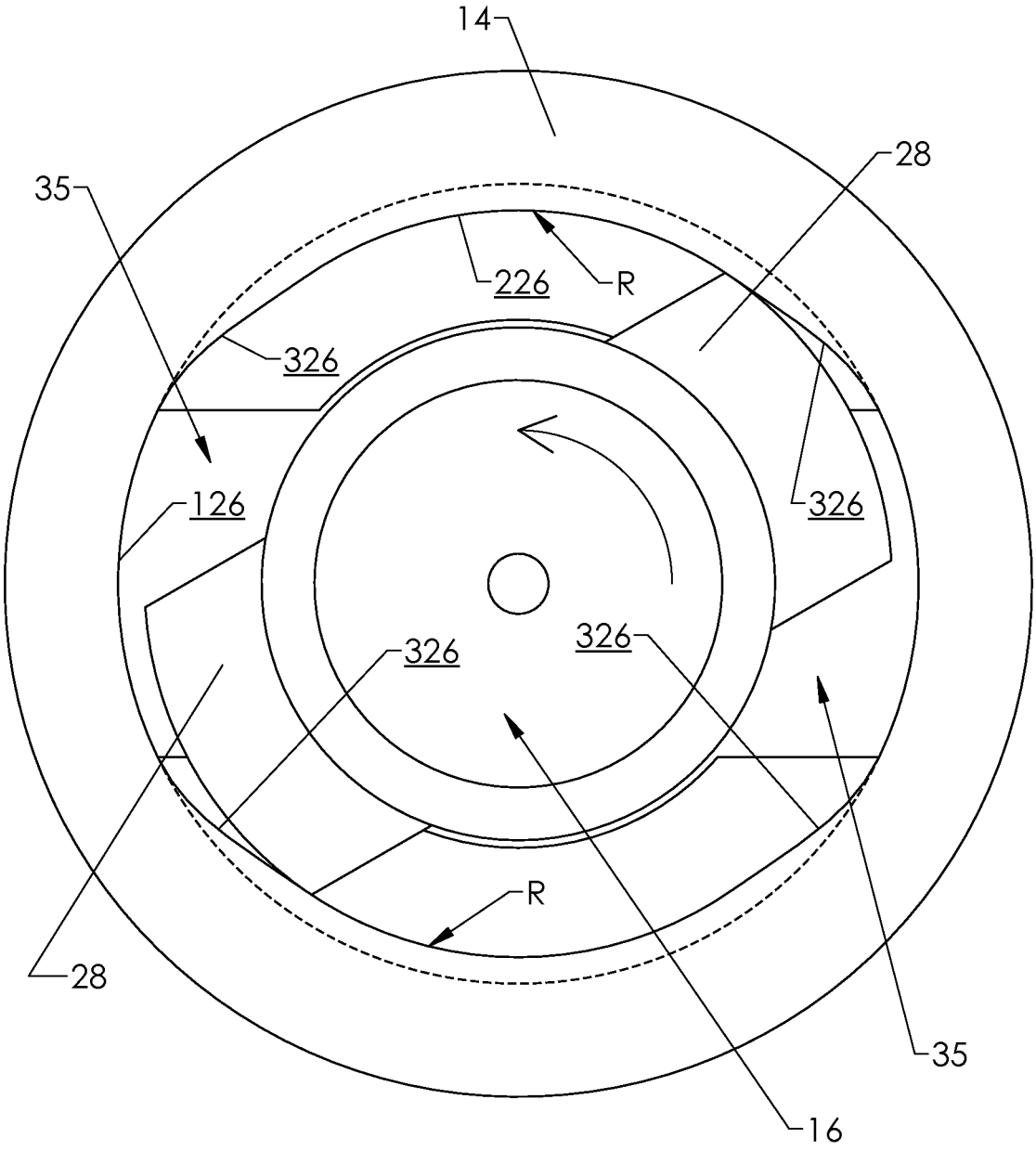
FIG. 11A is a schematic distal end view of the bolt of FIG. 10 being rotated counterclockwise, as in the right-handed action shown in FIGS. 1-9, wherein the outermost end surfaces of the lugs are beginning to slide along the ramps toward the crests of the ramps (the ramps being exaggerated for illustration).
Figure 21:
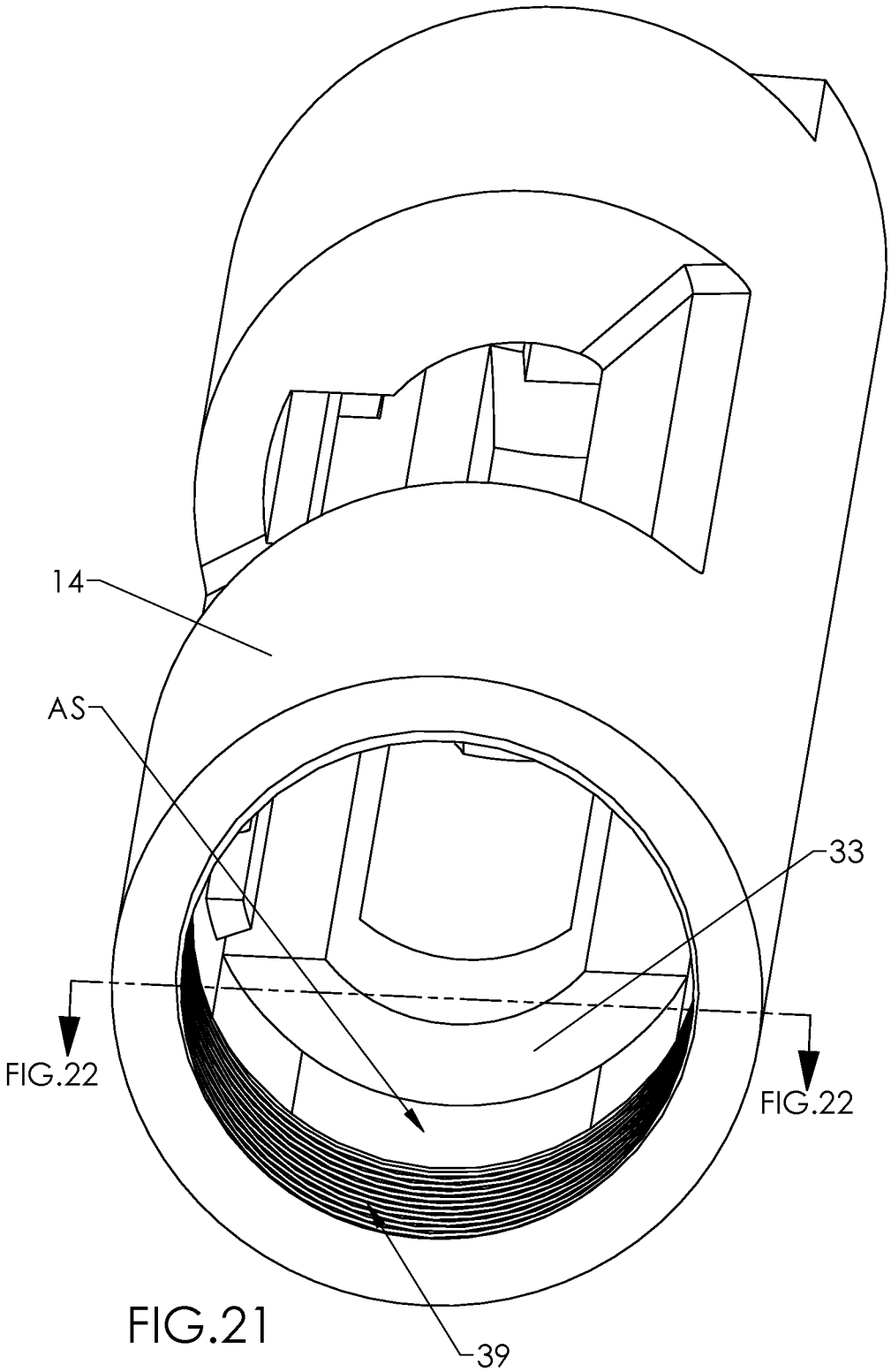
FIG. 21 is a distal end perspective view of the receiver of FIGS. 1-9, and 13-20, but wherein the bolt has been removed from the receiver.
Figure 22:
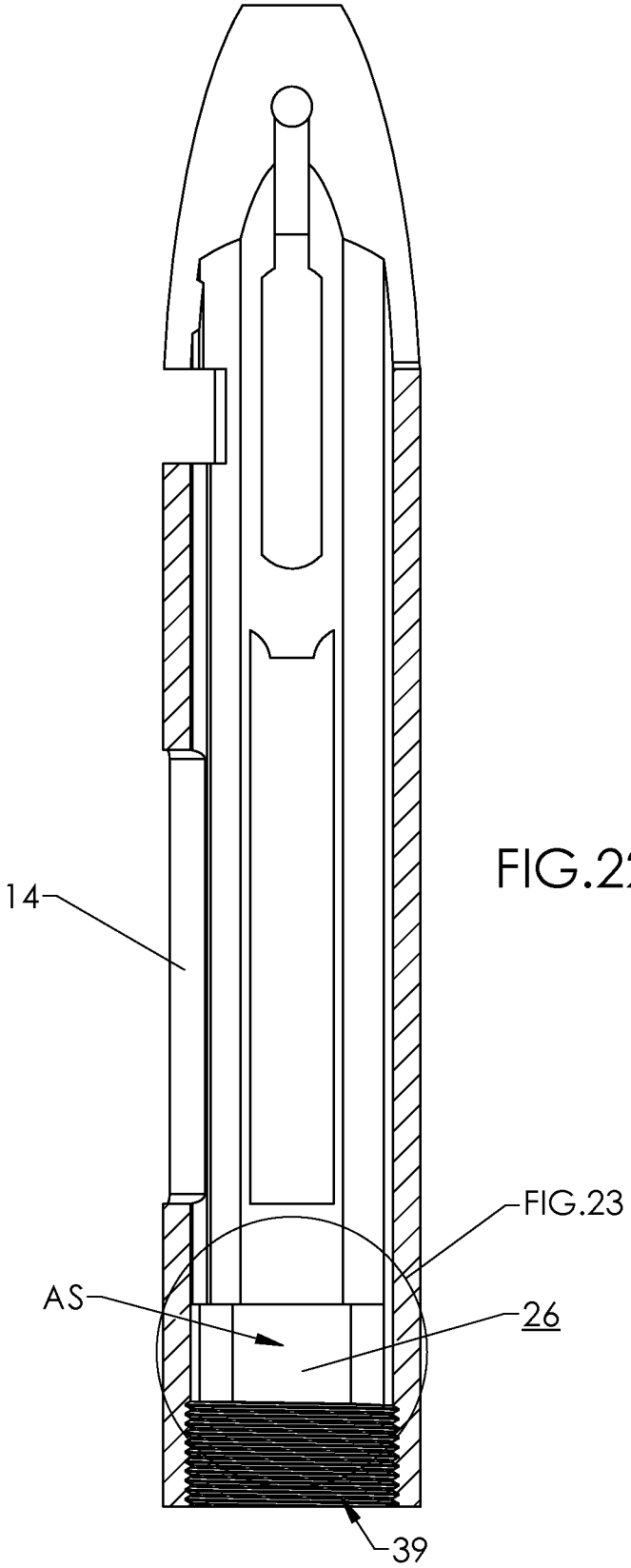
FIG. 22 is a cross-sectional view of the receiver of FIG. 21, viewed along the line 22-22 in FIG. 21.
Figure 23:
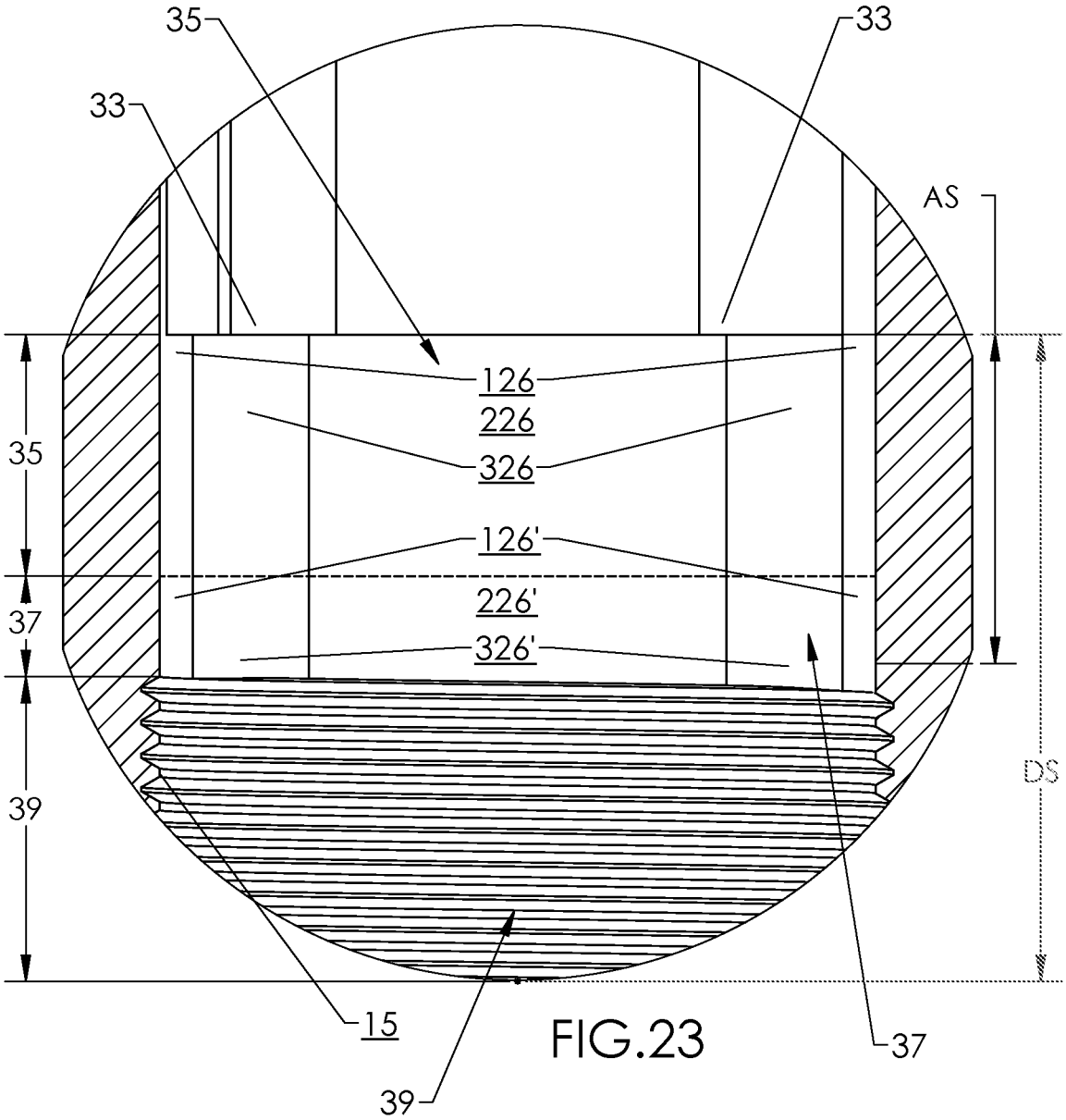
FIG. 23 is an enlarged detail view of the area circled in FIG. 22.
Figure 24:
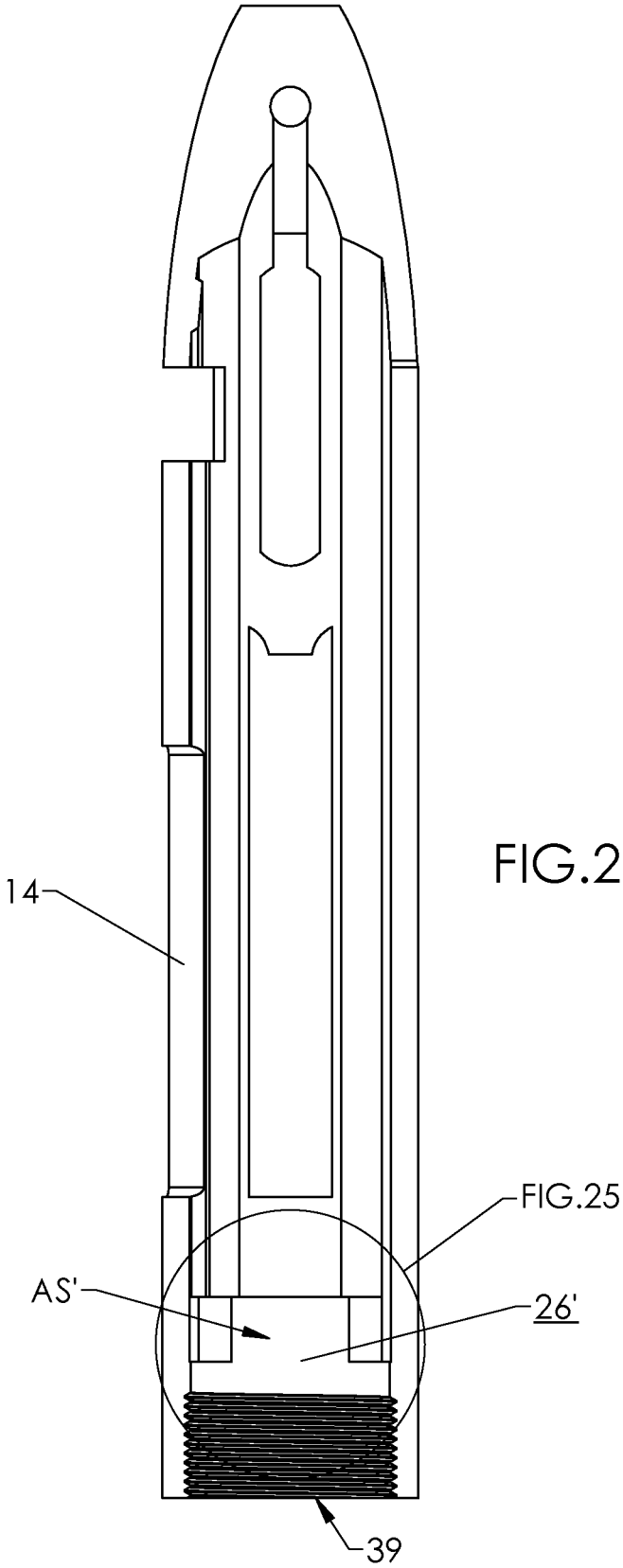
FIG. 24 is a cross-sectional view of the receiver of FIGS. 1-9, and 13-20, showing an alternative receiver distal inner surface curvature.
Figure 25:
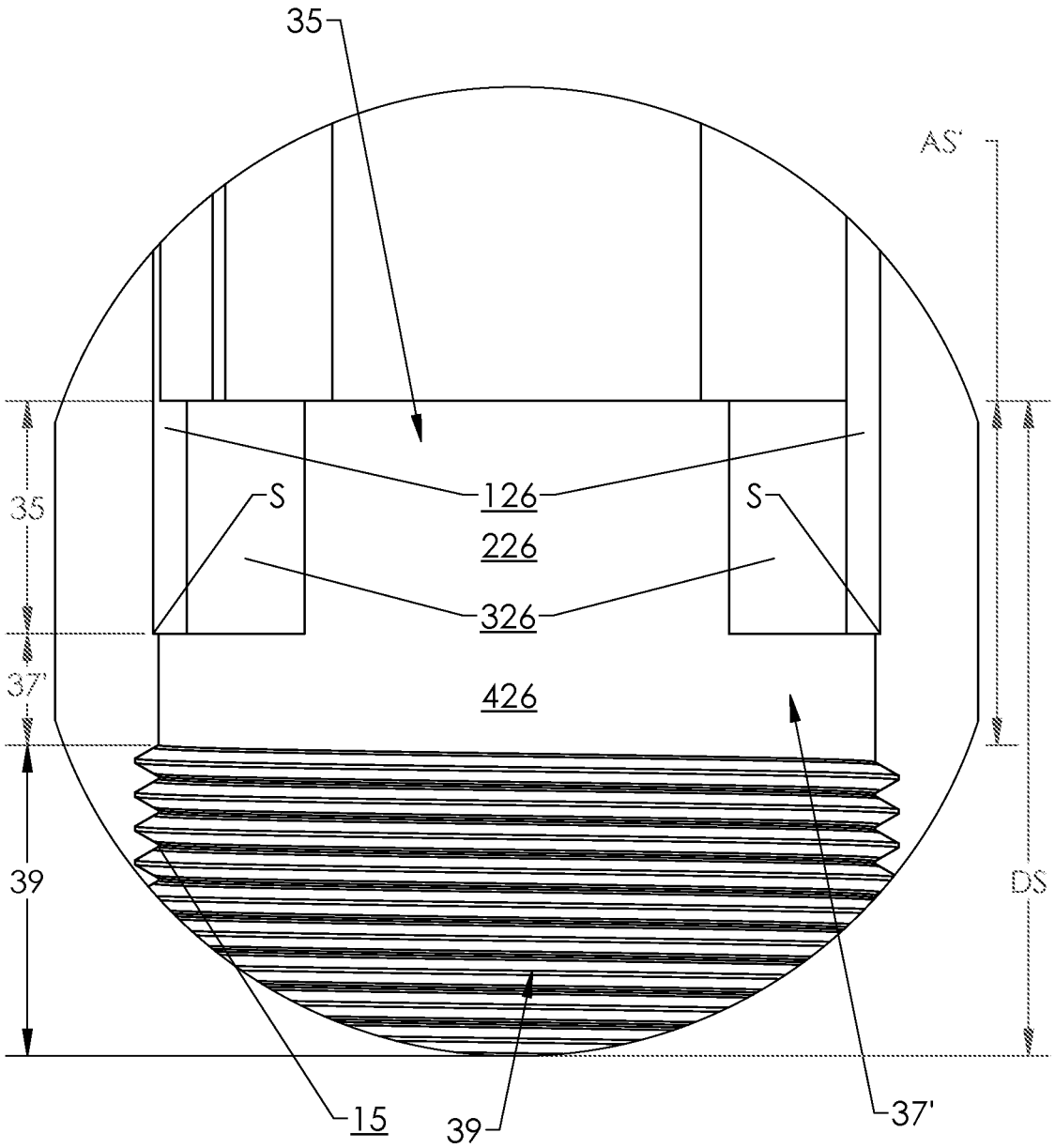
FIG. 25 is an enlarged detail view of the area circled in FIG. 24.

An assembly is shown in a bolt "loaded and unlocked" condition in FIGS. 1-9. FIGS. 10, 11A and B, and 12 schematically portray movement of the action from said loaded and unlocked condition to a "loaded and locked" condition that is detailed in FIGS. 13-20. FIGS. 21-23 show details of the distal receiver inner surface of the assembly that is non-cylindrical all the way, or substantially all the way, from the lug stops to the receiver threads. FIGS. 24 and 25 show details of an alternative curvature of the distal receiver inner surface, comprising the non-cylindrical surface in the lug rotation space (hereafter "lug space"), as in FIGS. 1-9, 13-20, and 21-23, but transitioning to a cylindrical surface near the receiver threads to define the tenon-receiving space.

Portions of one style of a firearm, a manually-operated, right-handed handle-operated bolt action rifle, are portrayed in the Figures, as a platform to describe preferred adaptations for improved accuracy while maintaining field-capability for the weapon. However, other styles of firearms having a bolt with locking lugs, and other styles of receiver, bolt, and barrel, and cartridge, may be used in embodiments of the invention, as will be understood after one of ordinary skill in the art of firearm design and manufacture views this disclosure. For example, a lever action, pump action, automatic action, and semi-automatic action firearm with a locking lug bolt may be used in embodiments of the invention. The adaptations may be made in many or all firearms with a locking lug bolt and the portions of the firearm not drawn herein (stock, forestock, trigger, firing pin, etc.) in the Figures will also be understood and may be conveniently built by those of ordinary skill in the art. For example, drawings of an entire bolt-action rifle are shown in U.S. Pat. No. 7,975,417 Duplessis et al and many other patents in this field.

FIGS. 1-9 illustrate an embodiment 10 that is an assembly of cooperating components, namely barrel 12, receiver 14 with threaded surface 15 for connection to the barrel threads, bolt 16, adapted according to preferred methods and structure of the disclosed technology, and a barrel nut 17 (present in some firearm designs) and a recoil lug 19. These components, with a rifle cartridge 18, are unassembled/exploded in FIG. 1. Exploded multiple parts of an example bolt main body are shown prior to welding of the parts together, but locking lug bolts of other construction, with more or fewer separable parts, and for actions other than manual, handle-operated bolt-actions, may be used in alternative embodiments.

Figure 2:
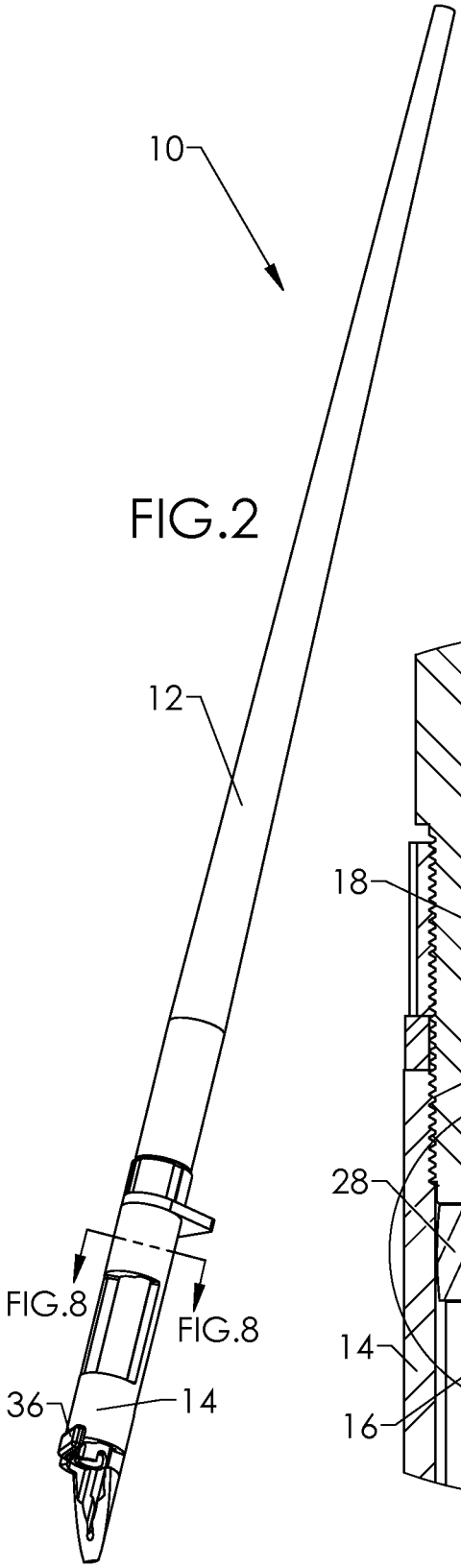
FIG. 2 is a top perspective view of the assembled components of FIG. 1, with the bolt in loaded but unlocked position.
Figure 3:
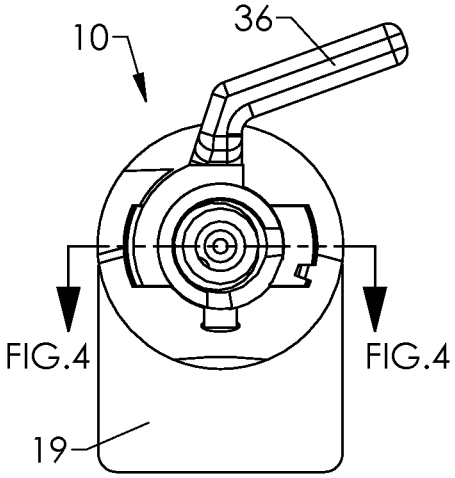
FIG. 3 is a proximal end view of the right-handed bolt action assembly of FIG. 2.
Figure 5:
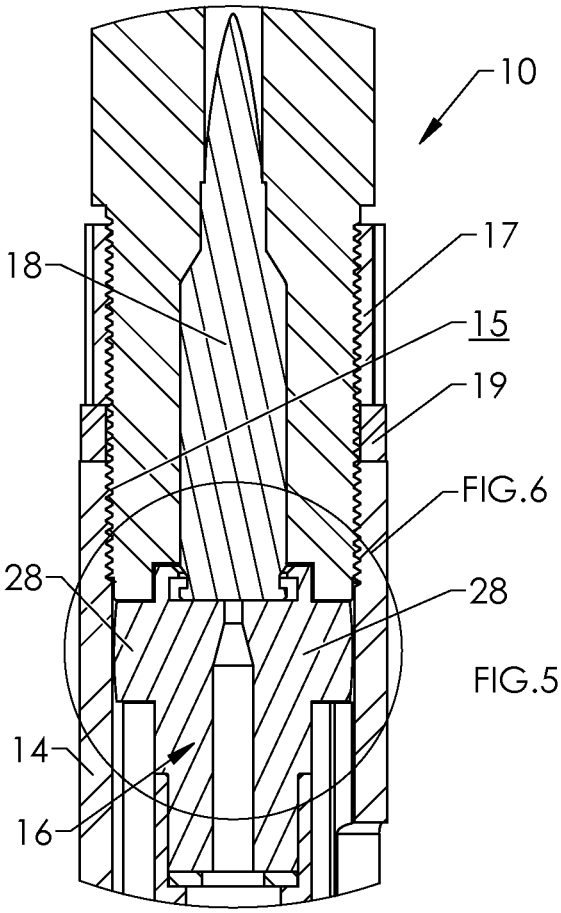
FIG. 5 is an enlarged detail view showing the distal portion of the receiver and bolt, the proximal end of the barrel, and a cartridge of the cross-sectional view of FIG. 4.
Figure 4:
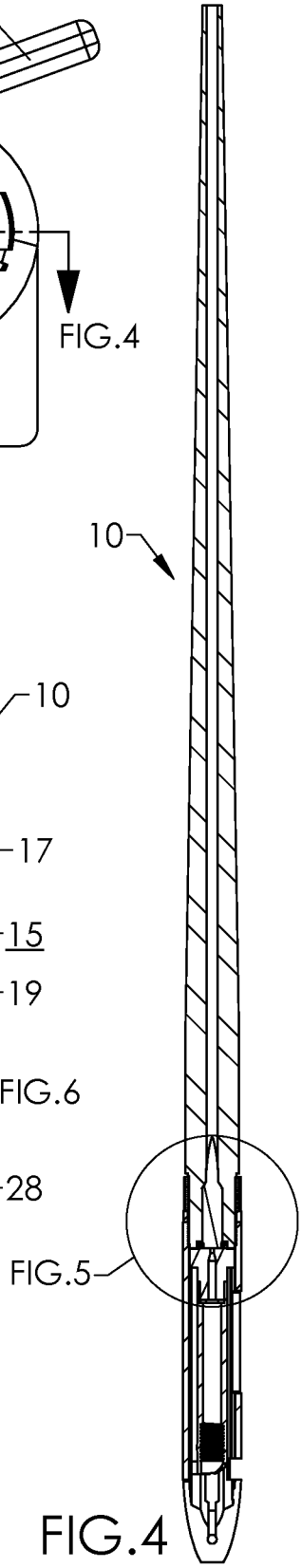
FIG. 4 is a cross-sectional view of the assembly of FIG. 2 viewed along the line 4-4 in FIG. 3.

FIGS. 2-9 show the exemplary assembly 10 with the bolt 16 in the "loaded but not locked" position, meaning that the user has pushed the bolt 16, by its handle, forward in the receiver bore (the "boltway" or "bolt raceway") to a full extent, wherein the bolt lugs 28 have slid through the openings between the lug stops 33 to enter the lug space 35, thus pushing the cartridge into the chamber. See also FIGS. 10 and 21-25 regarding call-out numbers 33 and 35. In FIGS. 2 and 3, the raised position of the bolt handle 36 is easily seen.

Figure 6:
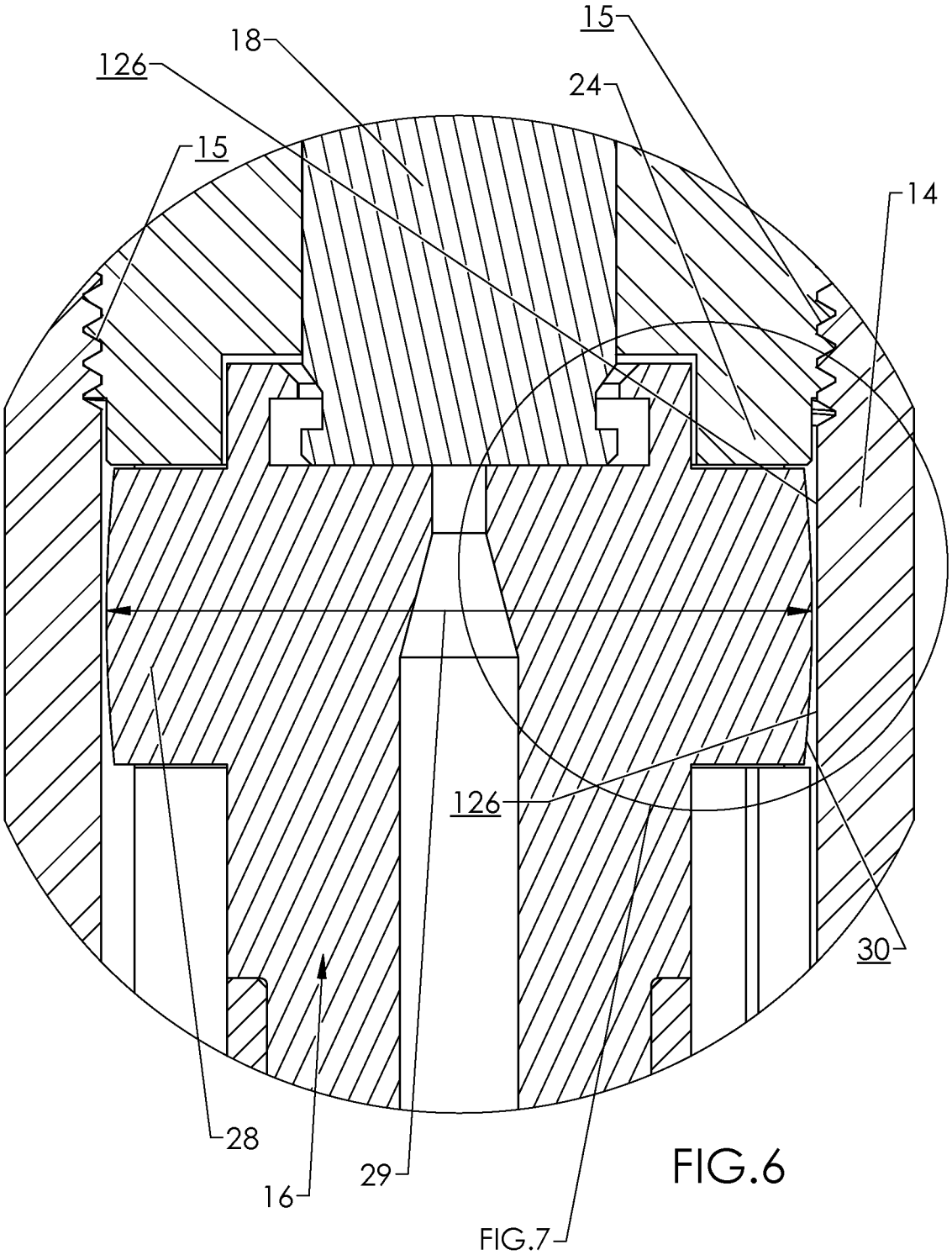
FIG. 6 is a further enlarged detail of the area circled in FIG. 5.
Figure 7:
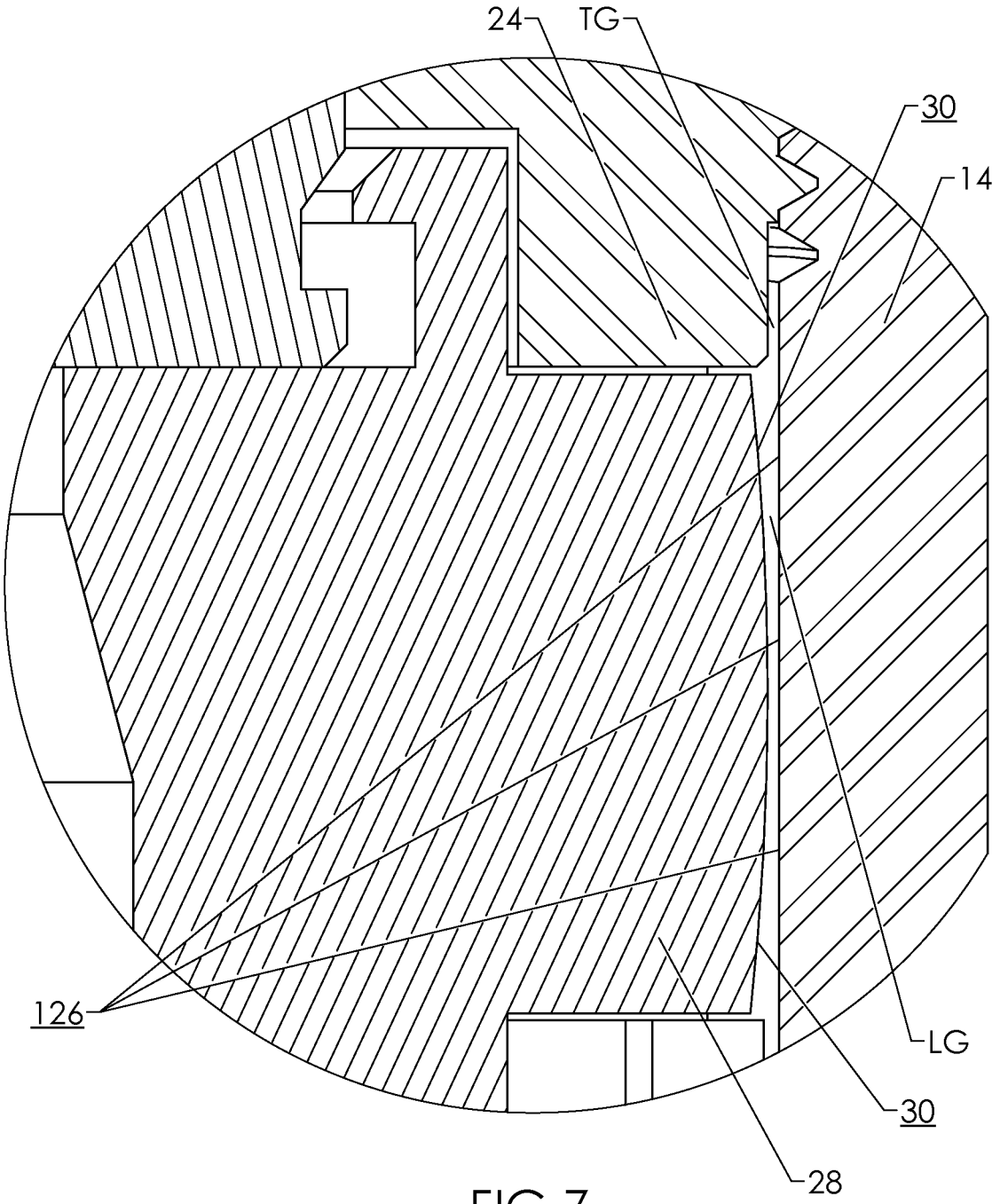
FIG. 7 is an enlarged detail of the area circled in FIG. 6.
Figure 8:
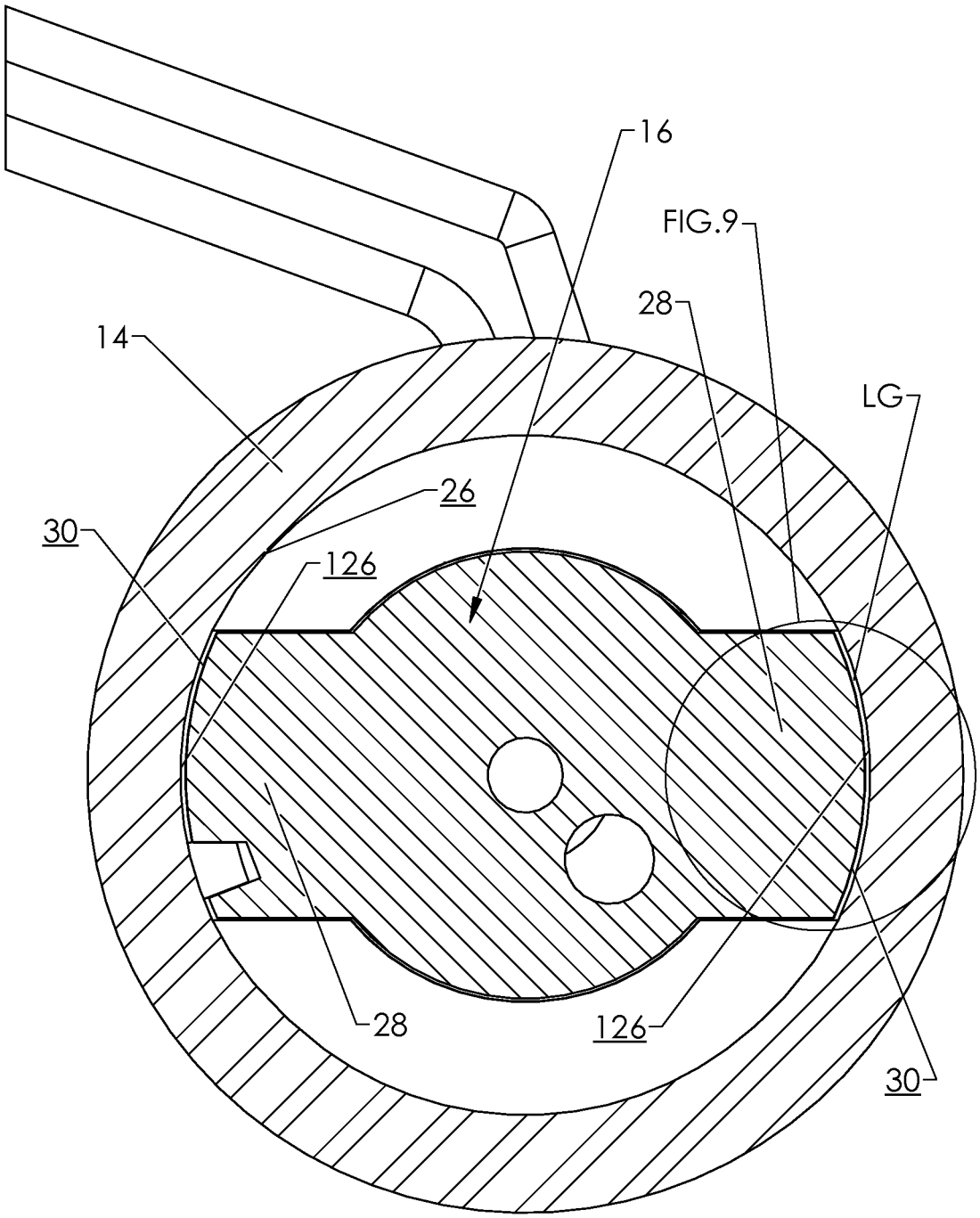
FIG. 8 is a distal end cross-sectional view of the assembly of FIG. 2, viewed along the line 8-8 in FIG. 2.
Figure 9:
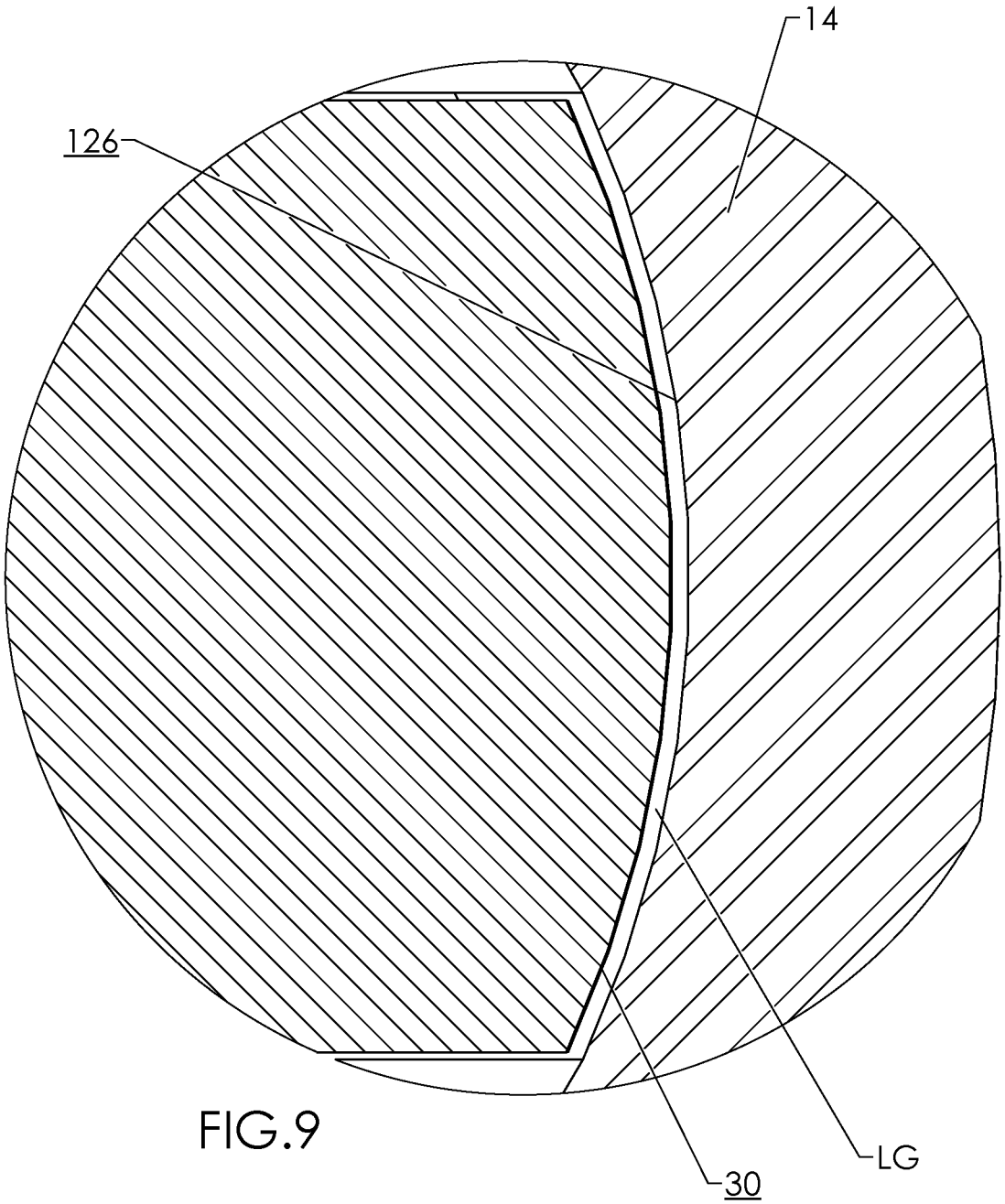
FIG. 9 is an enlarged detail of the area circled in FIG. 8.

FIGS. 4-7 are side cross-sectional views, and FIGS. 8 and 9 are end cross-sectional views, of the distal end of the bolt 16 with the lugs 28 in the unlocked position. The lugs 28 sit inside the lug space 35 encircled and defined by the non-cylindrical receiver inner surface 26, in that it curves to comprise a crest region preferably for each lug, and troughs between the crests, and transition areas extending between the crests and the troughs. In this embodiment, the receiver inner surface 26 non-cylindricality extends all the way to the threaded surface 15.

This unlocked position features a relatively-loose lug-to-receiver-surface relationship, as may be seen from the gap LG (FIGS. 7, 8, and 9) between the trough region 126 of the inner surface 26 of the receiver, and the outermost surface 30 (or "radially-outermost surface" or "radial-extremity surface") of the lugs, all along the axial length of the lugs 28 (shown in FIGS. 4-7), and all along the circumferential width of the lugs 28 (shown FIGS. 8 and 9). As will be further discussed below, the gap LG, and other important features of the receiver, barrel, and lug cooperation, is due to ramping of said receiver inner surface 26 in the lug space 35 (FIG. 23) to make the relationship of the lug outermost surface and the receiver inner surface 26 loose/distant in the trough regions 126 of the ramp, and the relationship of a portion of the lug outermost surface and the receiver inner surface 26 tight/close in the crest region 226 of the ramp. Gradual, slanted transition regions 336 lies between the troughs 126 and the crests 226 to clean/scrape the lugs and to help prevent blockage or binding during lockup.

FIGS. 4-7 also illustrate a preferred adaptation in the outermost surfaces 30 of the lugs 28, wherein the outermost surface 30 of the each of the bolt lugs 28 is curved, or otherwise non-linear, in the axial direction, to create at least one maximum diameter 29 and to reduce the surface area of each outermost surface 30 that comes closest to the receiver inner surface 26. This axial curvature or other axial non-linearity will be further discussed and shown to best advantage later in this document and its importance shown to best advantage in FIGS. 16-20.

FIGS. 8 and 9 show to best advantage the circumferential curvature of the outermost surface 30 of each lug, wherein the curvature is on a radius generally matching the radius of the inner surface 26 trough region 126. The outermost surfaces 30 are not intended to contact the trough regions 126, but are intended to contact the crest surface regions 226 but only at the maximum lug diameter 29. Therefore, the circumferential curvature of the lugs is generally the same as the trough region 126, but is not required to be accurate enough for mating with the trough region 126.

FIGS. 6 and 7 illustrate to best advantage the relationship of the non-threaded tenon 24 of the barrel 12 relative to the trough region 126 of the inner surface 26, in this embodiment wherein the non-cylindrical curvature of the inner surface 26 extends all the way to the threaded surface 15 and so encircles and defines the tenon-receiving space 37. The non-threaded tenon 24 is an example of an axial extension protruding proximally from the threaded portion of the barrel, wherein the tenon 24 is the rearmost (most proximal) portion of the barrel and has an outer surface that is cylindrical, smooth, and continuous. Due to the non-threaded tenon 24 being cylindrical, and the inner surface 26 being ramped/slightly-non-cylindrical through both the lug space 35 and the entire tenon-receiving space 37, FIG. 7 shows the small gap TG between the tenon 24 and the inner surface 26 in this trough region 126 of the receiver inner surface 26. Generally speaking, gap LG between the maximum diameter 29 of the lug 28 and the trough region 126 is about the same size as the gap TG between the tenon 24 and the trough region 126. It should be noted that lug gap LG and tenon gap TG are not instrumental in the centering/coaxial alignment of the bolt in the receiver or the barrel relative to the receiver. As will be explained later in this document, it is the tight tolerance/mating of the lugs and the tenon to the crest regions of the lug space 35 and tenon-receiving space 37, respectively, that are instrumental to this centering/coaxial alignment.

It may be noted that in alternative curvature versions of the receiver inner surface 26 more of the inner surface may mate with the tenon and further contribute to said centering/coaxial alignment of the barrel with the receiver. For example, when the entire surface 426 and resulting tenon-receiving space 37' are cylindrical, as in FIGS. 24 and 25, the entire outer circumference of the tenon will mate/press-fit with the surface 426. Therefore, it may be understood that the receiver inner surface may be shaped/curved so that the tenon-receiving space has the same shape/curvature as the lug space, or the receiver inner surface may change at or near its distal portion to be differently shaped/curved than its proximal portion that defines the lug space. For example, while the proximal portion defining the lug space comprises multiple crests and troughs, the distal portion defining the tenon-receiving space may have that a) same number of crests and troughs, b) a different number of crests and troughs, c) crests and troughs of the same diameters as those in the lug space; d) crests and troughs of different diameters as those in the lug space; or e) zero crests and zero troughs (cylindrical) wherein the resulting cylindrical diameter of the tenon-receiving space is the same as the crests of the lug space (as in FIGS. 24 and 25), or less preferably the same as the troughs of the lug space or a different diameter.

Figure 11B:
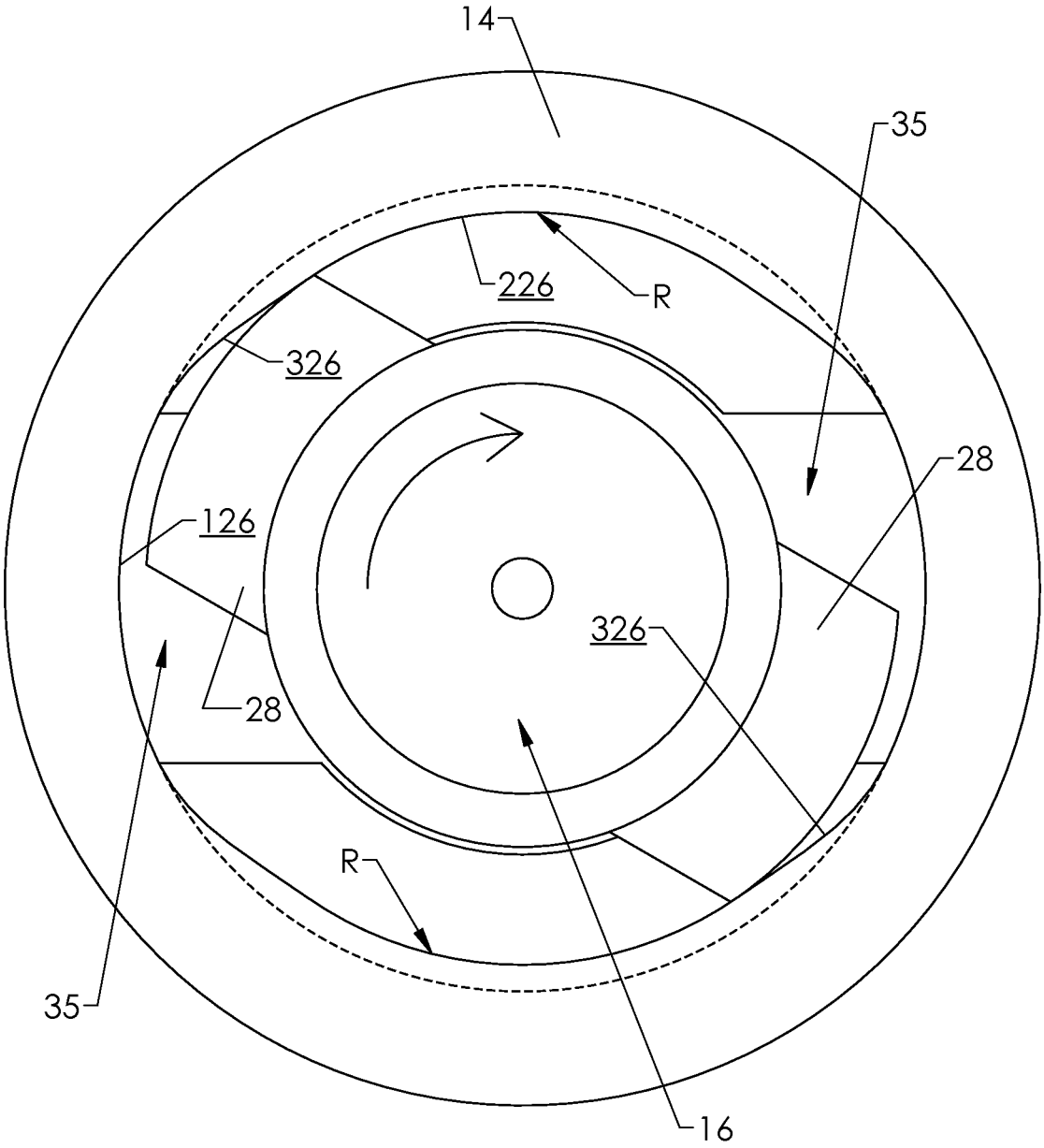
FIG. 11B is a schematic distal end view of the bolt of FIG. 10 being rotated clockwise, as in a left-handed action, wherein the outermost end surfaces of the lugs are beginning to slide along the ramps toward the crests of the ramps (the ramps being exaggerated for illustration).
Figure 12:
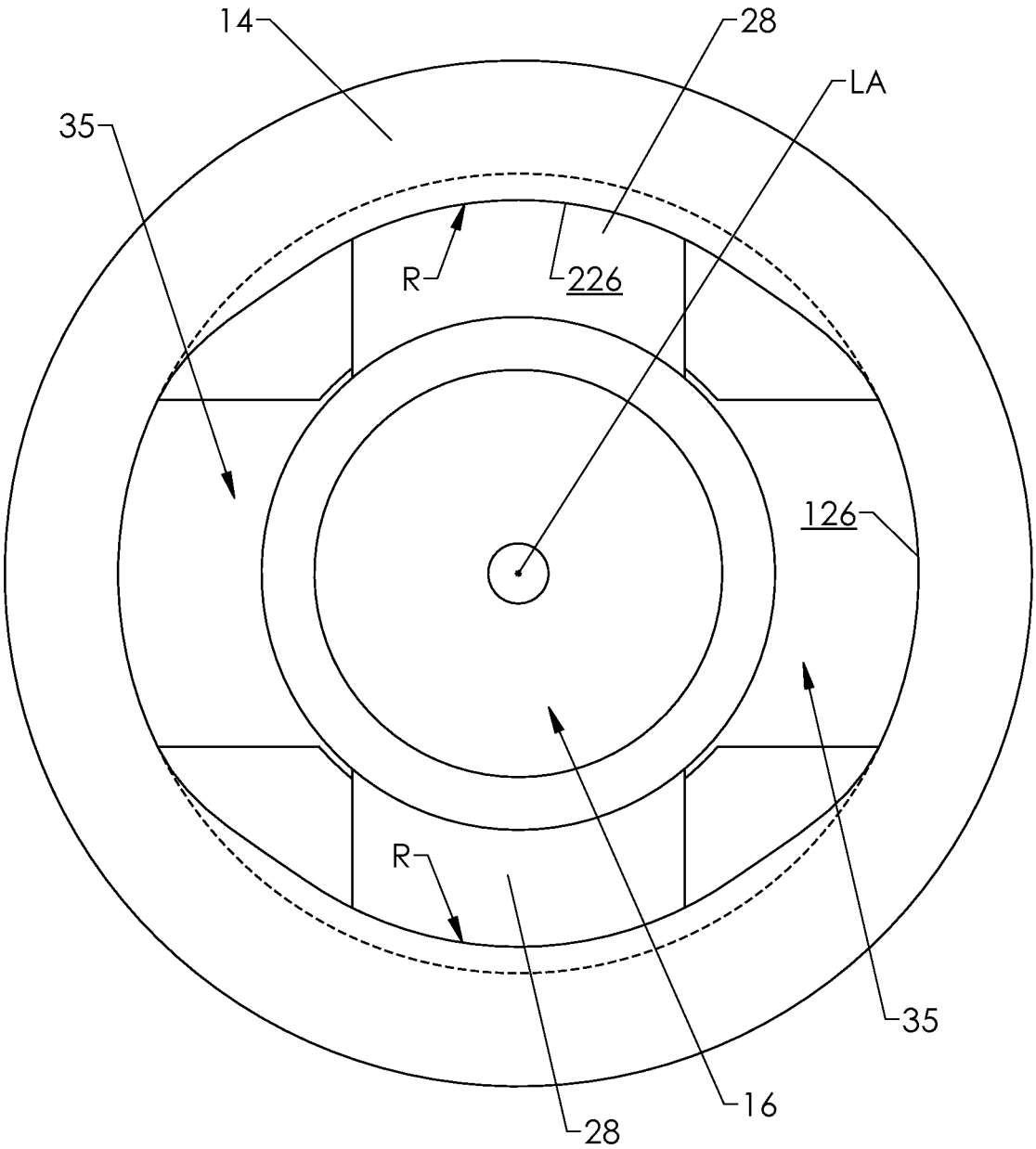
FIG. 12 is a schematic distal end view of the bolt of FIGS. 10 and 11A and B fully rotated clockwise into the loaded and locked position, wherein the outermost surfaces of the lugs are at/against the crests of the ramps, in the tight tolerance condition.
Figure 13:
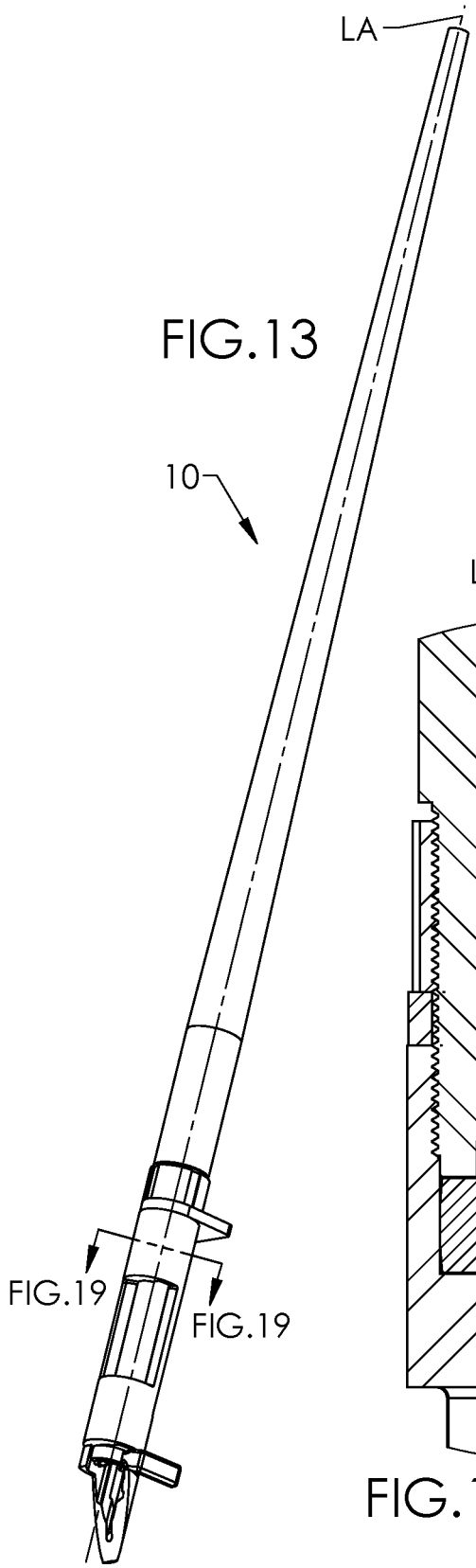
FIG. 13 is a perspective view of the assembly of FIGS. 2-9, but with the bolt rotated into the loaded and locked position.
Figure 14:
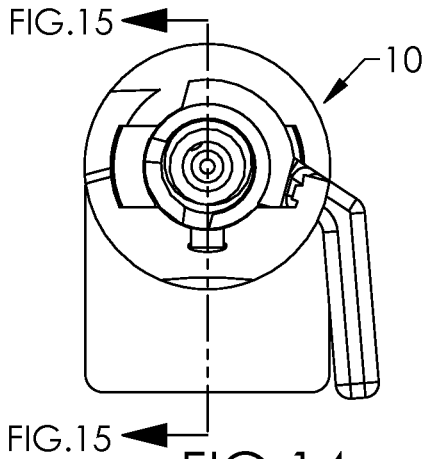
FIG. 14 is a proximal end view of the assembly of FIG. 13.

FIGS. 10-12 schematically portray, by exaggeration, the ramping of the receiver inner surface 26. Thus, FIGS. 10-12 schematically portray the difference in receiver inner surface diameters at different angular locations around the inner circumference of the distal portion of the receiver, in the lug space 35 where the bolt lugs 28 are rotated into and out of the locked condition. The ramps R, forming the slightly-non-cylindrical shape (here, generally oval or ovoid to accommodate two lugs) of the inner surface 26 comprise two troughs 126, and two crests 226, due to the troughs being relatively recessed and the crests being relatively protruding relative to the central axis of the receiver. The perpendicular arrows in FIG. 10 illustrates the trough diameter (maximum diameter, Dmax), and the crest diameter (minimum diameter, Dmin) of the lug space 35. The dashed lines indicate where the inner surface of the receiver would be if Dmax were constant around the receiver, thus, illustrating the "additional material" of the receiver main body 14 that is present, relative to the troughs, to create the crests of the ramps R. Note that the drawings show a two-lug (28) bolt (16), but, for different numbers of lugs, the receiver inner surface in the lug space would have more troughs and crests, for example, three lugs sliding into three troughs in the loaded but unlocked position, and then rotating to three crests in the loaded and locked position.

FIGS. 10-12 also illustrate the operation of the bolt, wherein the lugs 28 enter the lug space at the troughs 126 between the lug stops (FIG. 10), move along/near the ramps at the transition surfaces 326 (the beginning of the ramps between the troughs and the crests) (FIGS. 11A and B), and then reach the fully-rotated, loaded and locked position of mating/tight tolerance at/against the crests 226 (FIG. 12). FIG. 11A portrays counterclockwise rotation in a distal view, which is consistent with the right-handed action drawn in FIGS. 1-9 and which is generally representative of any action that uses this direction of bolt rotation. FIG. 11B portrays clockwise rotation in a distal view, for a left-handed user using a mirror image of the action drawn in FIGS. 1-9, and which is generally representative of any action that uses this direction of bolt rotation. Note that the lug space 35 is distal/forward of the lug stops 33, and, when the bolt rotates, the lugs 28 rotate on the bolt central axis, distal/forward of the lug stops 33. Therefore, it may be understood that the receiver inner surface 26, comprising ramps R with troughs 126 and crests 226, is distal (forward) of the lug stops 33.

FIGS. 13-20 illustrate the components and assembly of FIGS. 1-9, in the loaded and locked position corresponding to the position of schematic FIG. 12. In this locked condition, the receiver, bolt, and barrel are precisely coaxially aligned the longitudinal axis LA, which is called-out in FIGS. 13,15, 16, and 19. The barrel and receiver are precisely coaxially aligned in both the unlocked and locked bolt condition, because of the axial-surface mating of the barrel tenon with the receiver inner surface. The bolt, however, moves from what may be called "roughly" or "generally" coaxially aligned in the unlocked condition (FIGS. 1-9), to precisely coaxially aligned in the locked condition (FIGS. 13-20) when the bolt rotates into the tight tolerance position at the crests, to make the entire receiver, bolt, and barrel combination, and consequently the cartridge, precisely coaxial.

In this locked position, also called the "battery" or "ready for firing" position, the bolt 16 has been rotated to place the lugs 28 directly in front of the lug stops 33. Cartridge 18 is shown to best advantage in FIG. 16 in the loaded position in the rifle chamber, and will be understood from this disclosure to be very effectively centered and aligned with the barrel, receiver, and bolt central axes. The views of FIGS. 13-16 may be compared to FIGS. 2-5, wherein the differences in FIGS. 13-16 are that the bolt 16, including its lugs 28 and handle 36, has been rotated to the locked position from the unlocked position of FIGS. 2-5.

Figure 16:
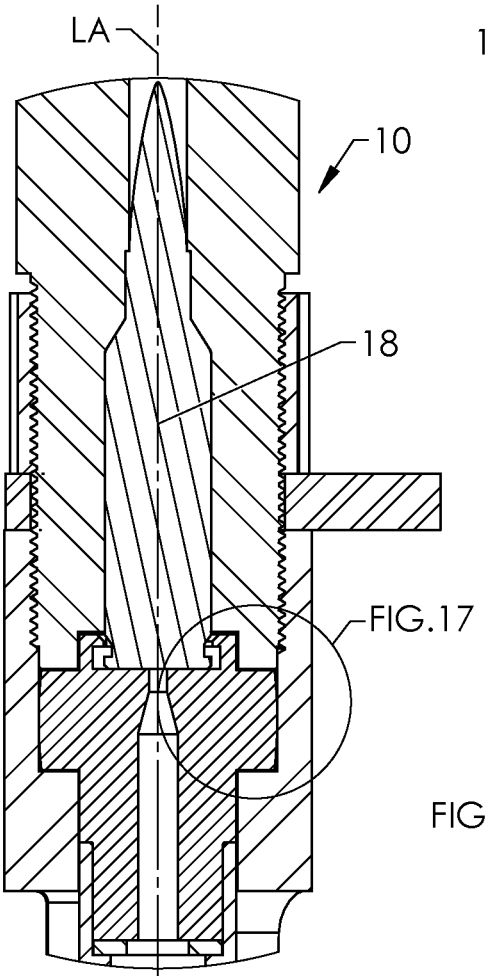
FIG. 16 is an enlarged detail view showing the distal portion of the receiver and bolt, the proximal end of the barrel, and a cartridge of the cross-sectional view of FIG. 15.
Figure 15:
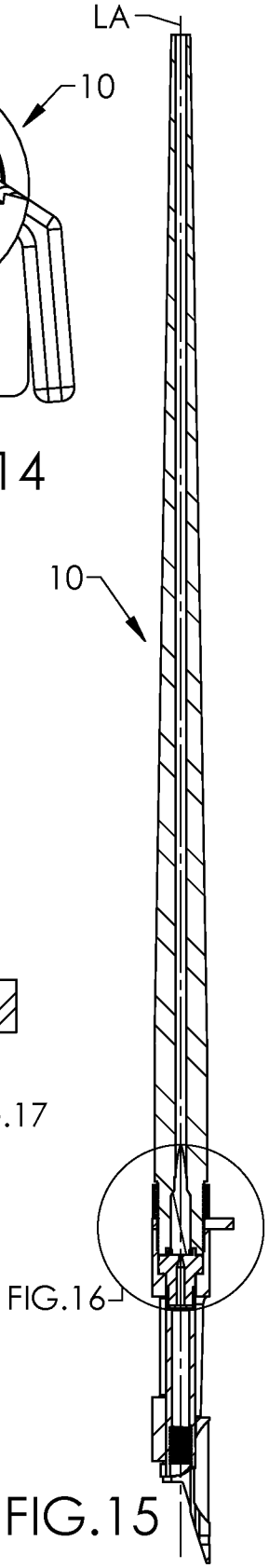
FIG. 15 is a cross-sectional view of the right-handed bolt action assembly of FIG. 13 viewed along the line 15-15 in FIG. 14.
Figure 17:
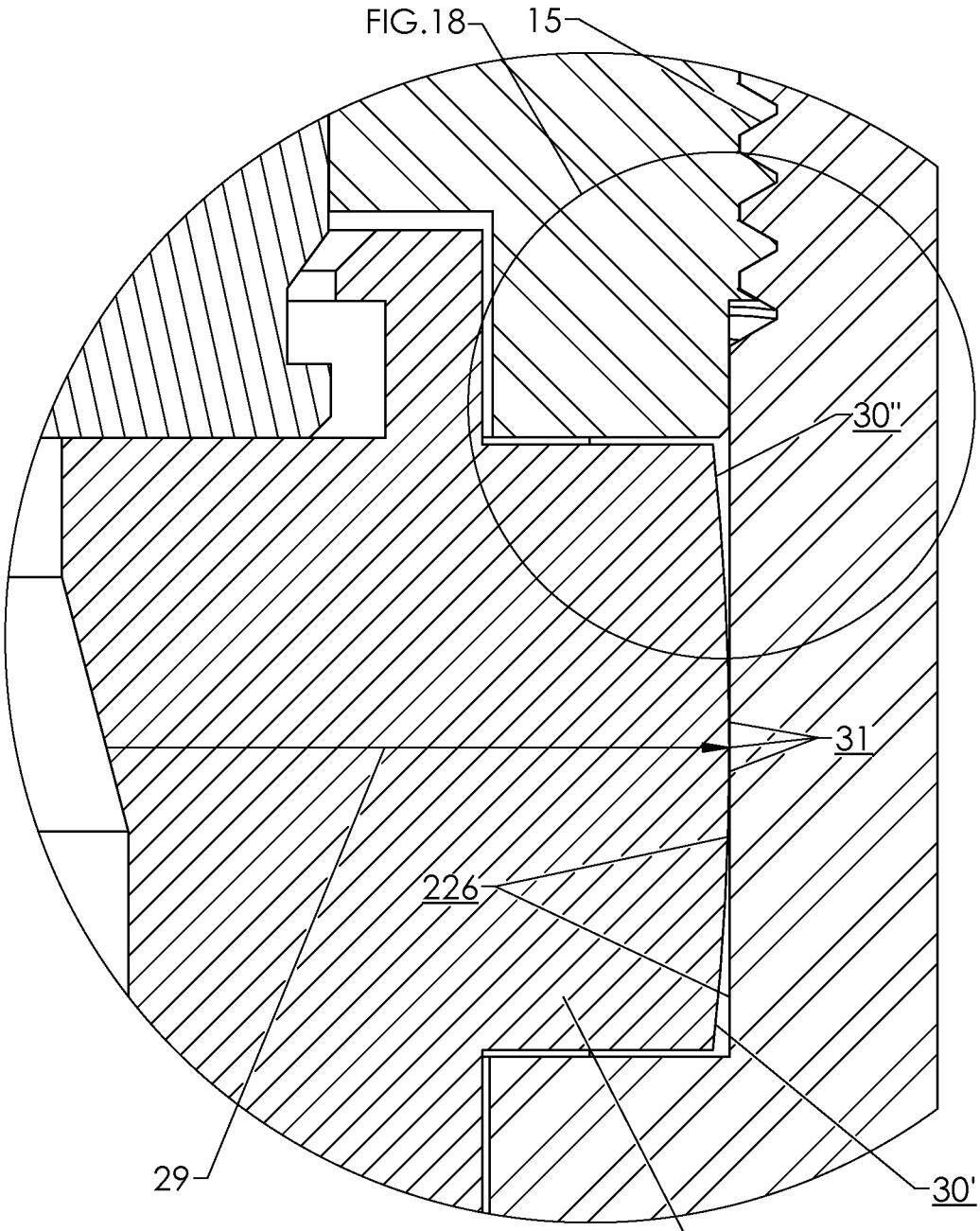
FIG. 17 is a further enlarged detail of the area circled in FIG. 16.
Figure 18:
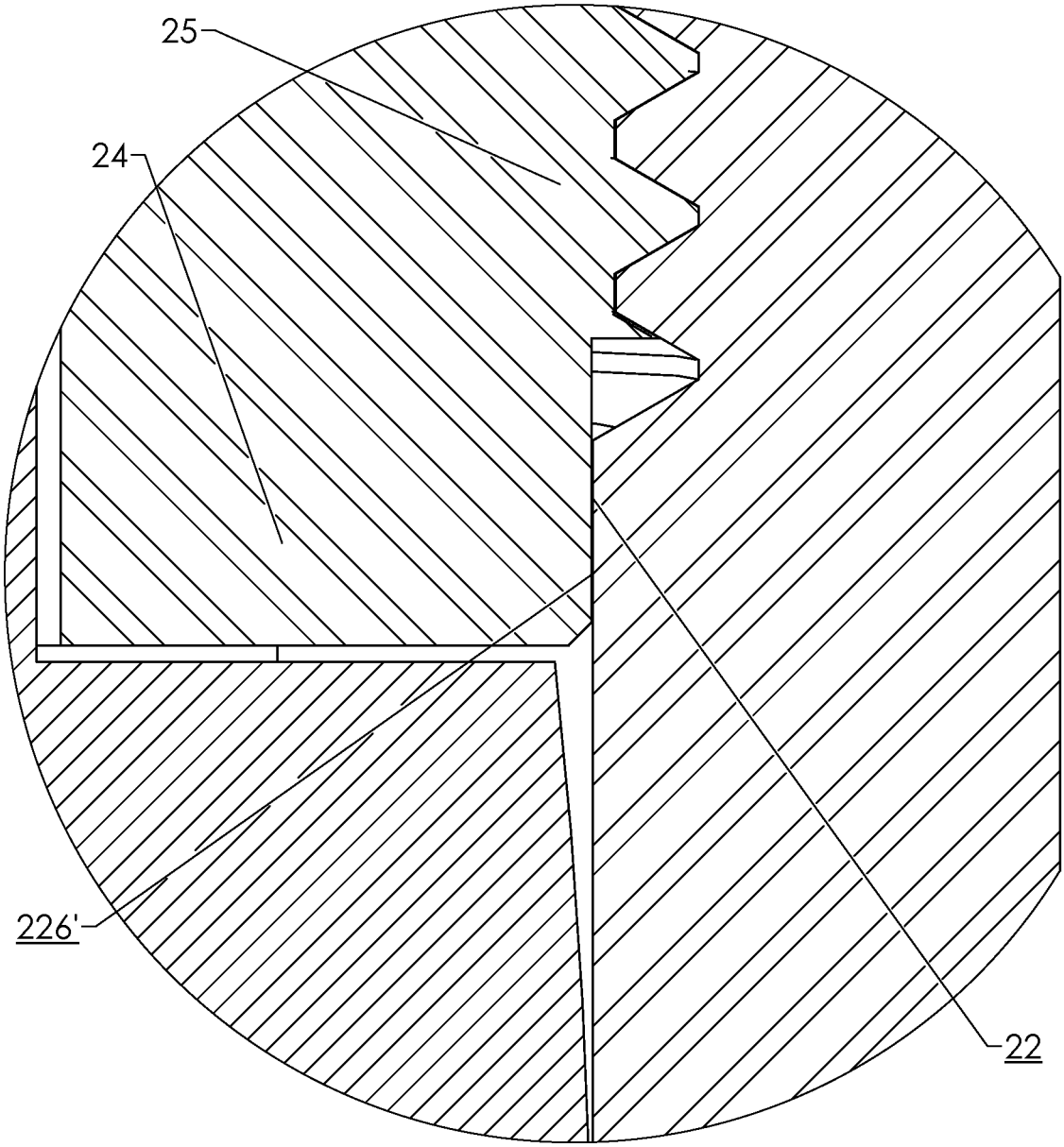
FIG. 18 is a further enlarged detail of the area circled in FIG. 17.

FIGS. 16-18 are side cross-sectional views, showing, in increasing enlargement, detail of the distal end of the bolt 16 with the lugs 28 in the locked position in the lug space. FIG. 17 shows to best advantage one example of axial non-linearity, for example, the axial curvature of the outermost surface 30 of the lug 28, that creates a maximum diameter 29 and a small surface area at that diameter 29 that is closest to the receiver inner surface 26. This way, in the unlocked position, there is substantial room between the bolt lug 28 and the trough region 126 for receiving ice or dirt from the field. Further, even in the locked position, there is room between the bolt lug 28 and the crest surface 226 both distally and proximally of the largest-lug-diameter 29 of the bolt lug 28, but there is a relatively-tight lug-to-receiver-surface relationship between the lug outermost surface 30 and the receiver surface ramp crest 226 in the area of the maximum diameter 29. Thus, the area of very tight tolerance (or even contact) is, in effect, a narrow rectangle or "line" of surface area 31 at the maximum diameter 29, about midway between the proximal and distal edges of the lugs in this example. The proximal edge surface region 30' and the distal edge surface region 30" are slightly further from the crest surface 226 due to the axial curvature of the lugs. The tight tolerance of the surface area 31 of the lug to the crest surface 126 of the receiver is preferably in the range of less than 0.004 inches, from each other. For example, the tight tolerance may be selected from 0.0039, 0.002, 0.001, 0.0008, or most preferably 0.0005-0.0003 inches, or alternatively any number of inches or ranges between these values. The axial curvature of each lug 28 may be one or more radii, for example, selected from the list of less than or equal to 4 inches, 0.5-4 inches, 3-4 inches, 2-3 inches, 1-2 inches, or 0.5-1 inches, or any number in these ranges.

Figure 19:
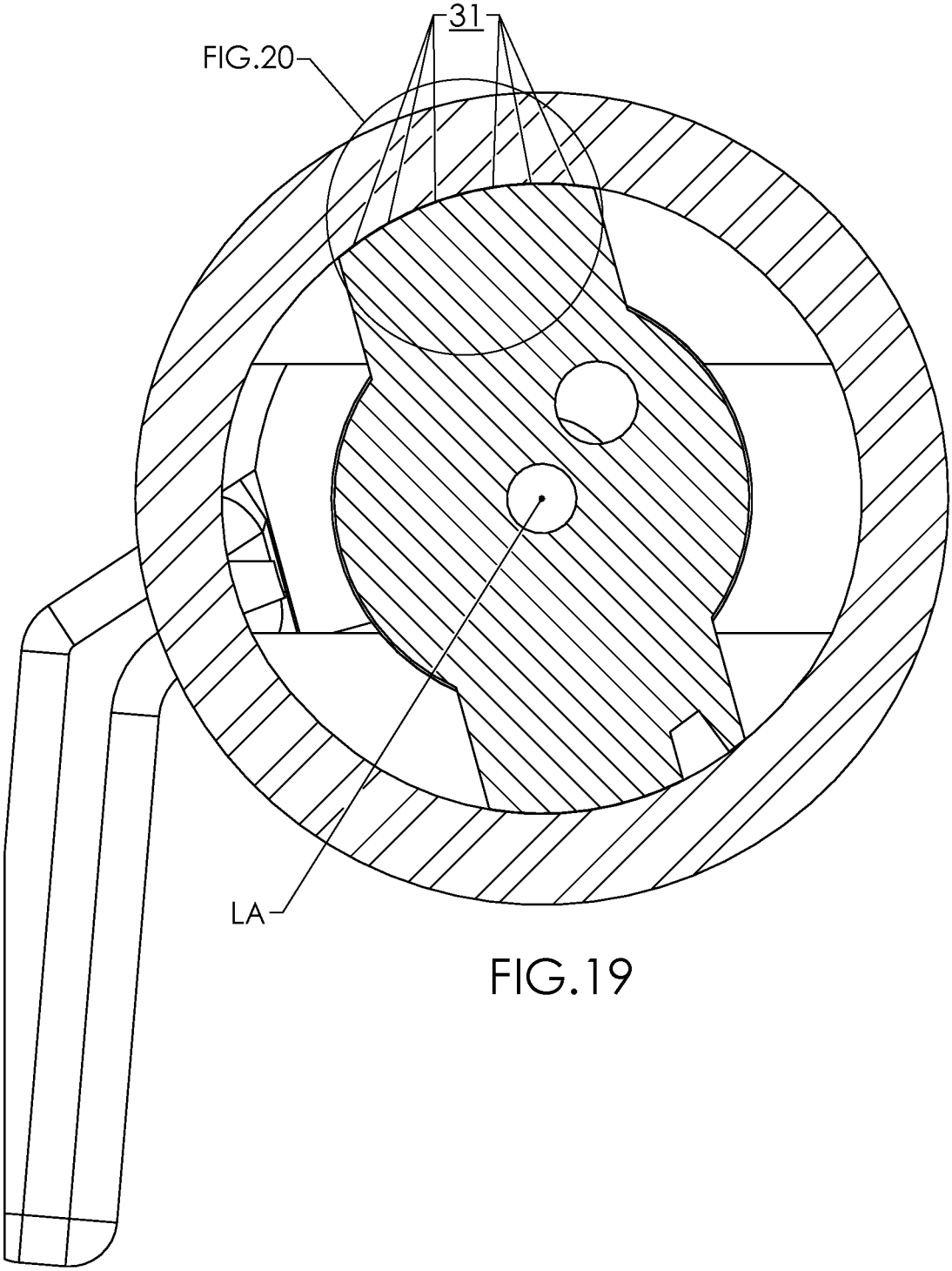
FIG. 19 is a distal end cross-sectional view of the assembly of FIG. 13, viewed along the line 19-19 in FIG. 13.
Figure 20:
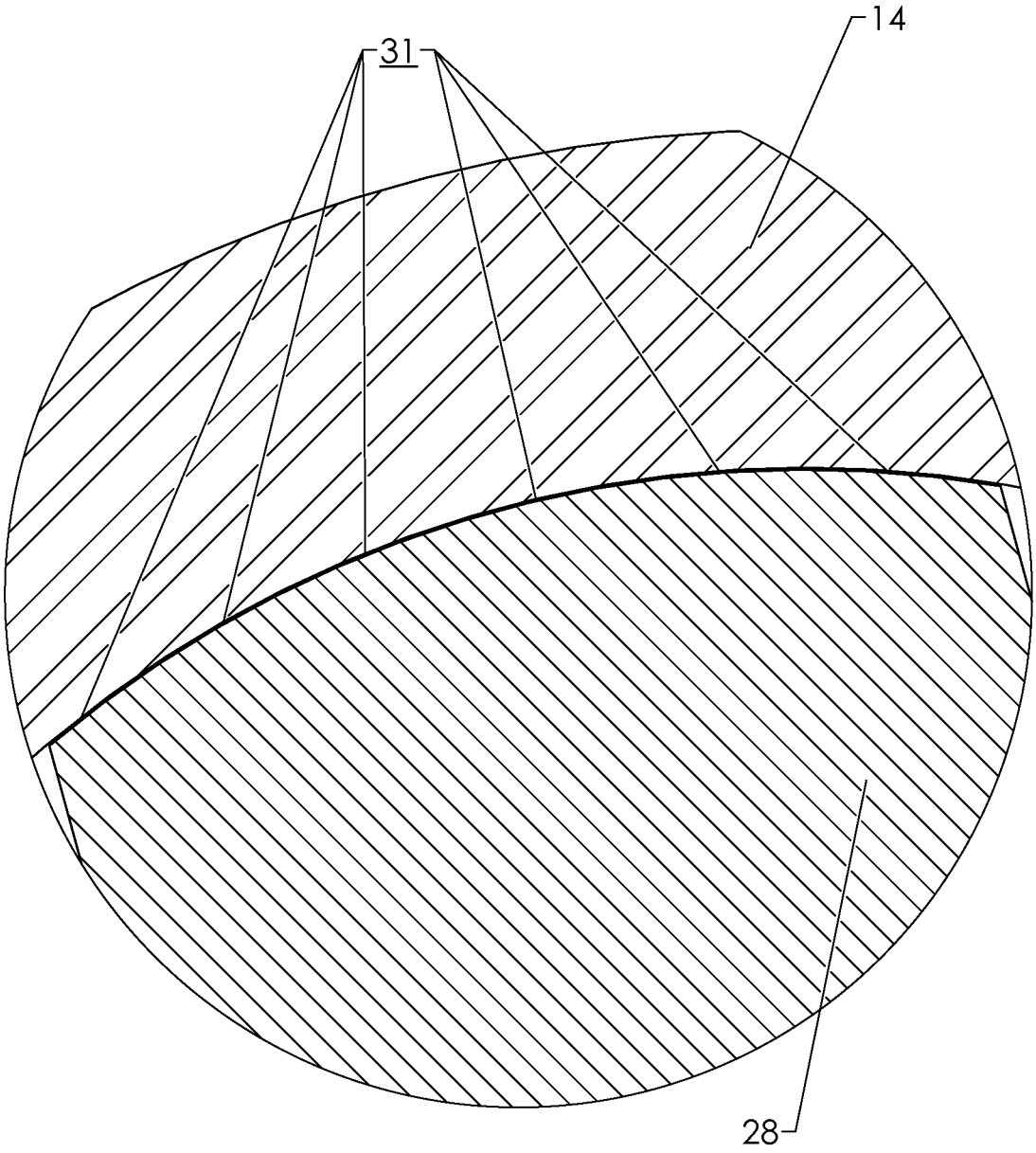
FIG. 20 is an enlarged detail of the area circled in FIG. 19.

FIG. 19 is a cross-sectional end view, and FIG. 20 is an enlarged detail of FIG. 19, wherein the receiver and bolt are cut at the location of the maximum diameter 29 of the lugs, showing how that region (surface area 31) is mated with the crest surface 226 of the receiver. Therefore, as may be understood best from FIGS. 17 and 19, the surface area 31 of mating/tight-tolerance of the lug to the crest 226 has a small axial dimension (FIG. 17), due to the axial curvature that purposely is provided to keep most of the outermost surface 30 away from the receiver surface 26 but has a longer circumferential dimension (FIGS. 18 and 19) due to the radial/circumferential curvature that generally matches the receiver surface 26 curvature.

FIGS. 17 and 18 show to best advantage a portion of the non-threaded tenon 24 of the barrel 12, which tenon 24 protrudes proximally from the threaded portion 25 of the barrel. The outer circumferential surface 22 of the tenon 24 is mated preferably in a press-fit with a distal region of the inner surface 26 of the receiver 14, specifically, a distal region of the crest surface 226. The threaded portion tenon 24 is cylindrical and of the same or almost the same outer diameter as the crest surfaces 226 and therefore opposing sides of surface 22 will mate with the crest surfaces 226. Preferably, said mating of the opposing sides of surface 22 with the crest surfaces 226 means the same tolerance as the lug surface area 31 to surface 226, or preferably less than 0.004 inches, from each other. For example, the mating may be selected from 0.0039, 0.002, 0.001, 0.0008, 0.0005, 0.0004, 0.0003, 0.0002, 0.0001 inches, or less, or alternatively any number of inches or ranges between these values. The sides of surface 22 that are 90 degrees from those mating with surface 226 will be spaced from the trough surfaces 126, as shown by the gap TG between the tenon 24 and the trough surface 126 in FIG. 7. It will be understood from this disclosure that mating of opposing sides of the tenon with the receiver inner surface, while other sides (90 degrees from the areas of mating) are not mating with the receiver inner surface, will result in an excellent coaxial and concentric relationship of the barrel 12 to the receiver 14. Or, in alternative curvature versions of the receiver inner surface that have fewer or no troughs in the region receiving the tenon, the increased amount of receiver surface area that mates with the tenon may further enhance the coaxial and concentric relationship of the barrel 12 to the receiver 14. These axial-mating connections are superior to a threads-only connection, because of the inherent axial-play in the threaded connection and the resulting inaccuracy and canting to off-of-coaxial. Therefore, the axially-mated non-threaded tenon, even if it is along only opposing portions of the tenon, will be significantly more accurate and coaxial than a threaded connection. Note that, if other numbers of lugs 28 are present on the bolt, the areas of mating of the non-threaded tenon to the receiver inner surface may be different in number and location. Also, note that various non-threaded tenon 24 lengths may be used, for example, ones longer relative to the threaded portion 25 than that portrayed in the drawings. For example, certain embodiments may have a non-threaded tenon 24 in the range of ¼-1 inch, or at least ¼ inch, at least ⅓ inch, or at least ½ inch in axial length, for mating with the receiver.

During installation of the barrel in the receiver, the barrel will be rotated into the receiver, by virtue of the threading, and the tenon 24 will become press-fit into the receiver to mate with surface 26 at the crests 226. This is possible because the tenon 24 has an outer diameter the same or slightly less than the minimum diameter of the receiver inner surface 26, so there will be no obstructions to connection of the barrel in this manner. And, because the barrel is mated to the receiver during initial factory assembly, and the barrel is designed not to rotate or otherwise move at this press-fit connection relative to the receiver during operation, the tight tolerance of such a press-fit into the receiver is not susceptible to contaminants experienced in field use.

FIGS. 21-23 are views of the receiver 14, wherein the bolt and barrel have been removed to show the lug space 35 immediately distal of the lug stops 33, the tenon-receiving space 37 immediately distal of the lug space 35, and the threaded space 39 immediately distal of the tenon-receiving space 37 and at the distal extremity of the receiver. Collectively/combined, as represented by the vertical arrows at the sides of FIG. 23, the lug space 35 and the tenon-receiving space 37 are called herein the alignment space AS, as both functions of lug mating and tenon mating in that space AS are important to the coaxial alignment of the components as discussed above. Also, all of said spaces 35, 37, and 39 may collectively/in-combination be called the distal portion or distal space DS of the receiver and receiver bore. Cross-sectional views FIG. 22 and enlarged FIG. 23 illustrate the inner surface 26 that is comprised of trough surfaces 126 and crest surfaces 226 all the way between the lug stops 33 and the receiver threads. In FIG. 23, a dashed line represents an imaginary boundary on the receiver inner surface 26 proximal regions of surface 26 and the distal regions of surface 26, which are shaped the same but which cooperate with different structures, that is, which define the lug space 35 for cooperating with the lugs and the tenon-receiving space 37 for cooperating with the barrel. More specifically, the dashed line separates: 1) a proximal region that receives the lugs, with trough surfaces 126 in the locations wherein the lugs first enter the lug space 35, and crest surfaces 226 with which the lugs mate when the lugs are in locked position, and 2) a distal region that receives the non-threaded barrel tenon surface 22, with crest surface 226' for mating with the tenon surface 22 and trough surface 126' distanced from the tenon surface 22. Transition surfaces 326, 326' are illustrated as regions of transition between the trough and crests, in other words, the beginning of the ramps in the proximal region and the distal region, respectively.

FIGS. 21-23 portray an example of a smooth, ramped receiver inner surface 26, having spaced-apart crests, for mating with each lug and with portions of the barrel tenon. In this curvature version, said ramped surface continuously extends all the way from the lug stops to the barrel-receiving threads, as this continuity has benefits of excellent barrel-to-receiver alignment plus excellent machining efficiency, accuracy, and precision. However, in certain other embodiments, the receiver inner surface may have an alternative curvature, for example, comprising different shapes and/or different diameters in various regions between the lug stops and the receiver threads. For example, the lug space may have ramped surfaces such as are discussed above, but the barrel tenon-receiving space may have different numbers of ramps, or may be exactly-cylindrical in order to have full contact/tight tolerance all the way around the non-threaded tenon of the barrel.

One example of an alternative curvature is shown in FIGS. 24 and 25, wherein receiver inner surface 26' surrounds and defines the alignment space AS' but has different proximal and distal portions. In FIGS. 24 and 25, the portion of the receiver inner surface 26' defining the lug space 35 is ramped as discussed above, and so comprises troughs 126, crests 226, and transitions 336 as described above. The portion of receiver inner surface 26' (surface 426) that surrounds and defines the tenon-receiving space 37', however, is different from that of the lug space, in that it is not ramped and instead is a cylindrical surface of the same diameter as the crests 226 of the lug space. In other words, the receiver inner surface portion 426 defining the tenon-receiving space 37' is "all crest" and "no trough". Note that there is a line shown in FIG. 25 between surface 426 and the surfaces of both the troughs 126 and transitions 326, but there is no line in FIG. 25 between the surface of the crest 226 and the surface of the tenon-receiving space 37', as surfaces 226 and 426 are different portions of the same surface, and are the same diameter.

One may see, at shoulder S in FIG. 25, the difference in, and transition from, the diameter of surface 426 compared to the relatively larger diameter of the troughs 126. FIG. 25 is drawn to-scale, as are FIGS. 1-9, and 13-24, for an exemplary standard handheld hunting or combat rifle, and so the shoulder S is fairly small, but it will understood from the above disclosure that a small difference in the diameters of the troughs vs the crests in the alignment space AS, AS' can provide a large benefit in coaxial alignment and resulting shooting accuracy. To emphasize the difference in diameters, for easier viewing, schematic FIGS. 10, 11A and B, and 12 are provided but are not drawn-to-scale for most firearms actions.

Although the invention has been described above with reference to particular means, materials, and embodiments, it is to be understood that the invention is not limited to these disclosed particulars, but extends instead to all equivalents within the broad scope of this disclosure and/or of the following claims.

The invention claimed is:

1. A firearm action comprising:

a receiver having a boltway defined by a receiver inner surface, a longitudinal axis extending between a rear end of the receiver and a forward end of the receiver that is for connection to a firearm barrel, and a radial dimension transverse to the longitudinal axis;

a bolt longitudinally-slidable in the boltway, the bolt comprising multiple locking lugs spaced apart around a forward end of the bolt, and each of the multiple locking lugs having a radially-outermost surface; and lug stops each extending radially into the boltway near said forward end of the receiver, and each having a forward-most extremity;

wherein an axial portion of the receiver inner surface comprises multiple ramps forward of the forward-most extremity of the lug stops, each ramp having a crest surface and a trough surface, wherein each trough surface has a trough diameter and each crest surface has a crest diameter that is smaller than the trough diameter;

wherein the bolt is rotatable in the boltway from an unlocked position wherein the locking lugs radially-outermost surfaces are at the trough surfaces of said ramps of said axial portion, forward of the lug stops forward-most extremities, and distanced from the trough surfaces by a gap greater than or equal to 0.010 inches, to a locked position where the radially-outermost surfaces of the locking lugs are at the crest surfaces of said ramps of said axial portion, and forward of the lug stops forward-most extremities, and mating with the crest surfaces by being less than 0.0040 inches from the crest surfaces to center the bolt in the boltway.

2. A firearm action comprising:

a receiver having a boltway defined by a receiver inner surface, a longitudinal axis extending between a proximal end of the receiver and a distal end of the receiver for connecting to a firearm barrel, and a radial dimension transverse to the longitudinal axis;

a bolt slidably and rotatably received in the boltway; and lug stops each extending radially into the boltway near the distal end of the receiver, and each lug stop having a distal extremity that is perpendicular to the longitudinal axis;

wherein the bolt has multiple locking lugs extending radially from the bolt and each having a radial extremity surface, wherein the bolt is slid distally to move the locking lugs through spaces between the lug stops into an unlocked position, and the bolt is rotated from the unlocked position into a locked position wherein the locking lugs are positioned distal of the lug stops to abut against the distal extremity of the lug stops during firing to prevent blowback of the bolt;

wherein the boltway receiver inner surface comprises crests and troughs that are distal of said distal extremity of the lug stops, and, when the bolt is in the unlocked position, the radial extremity surfaces of the locking lugs are at the troughs, and when the bolt is in the locked position, the radial extremity surfaces of the locking lugs mate with the crests to center the bolt in the boltway.

3. The firearm action as in claim 2, wherein, in said locked position, the locking lugs are entirely distal of said distal extremity.

4. The firearm action as in claim 2, wherein said radial extremity surfaces of each of said locking lugs has an area of maximum diameter that mates with the crest in the locked position, and at least one recessed area of smaller diameter that does not mate with the crest in the locked position, wherein the at least one recessed area is distal or proximal relative to said area of maximum diameter for collecting debris during rotation of the bolt.

5. A firearm action comprising:

a receiver having a proximal end, and a distal end for connection to a firearm barrel, the receiver having a boltway surrounded and defined by an inner receiver surface, wherein the boltway has a longitudinal axis and a radial dimension transverse to the longitudinal axis, and the receiver further has lug stops extending into the boltway;

wherein the elongated bolt has a bolt longitudinal axis, a bolt radial dimension transverse to the bolt longitudinal axis, and multiple locking lugs extending radially from the bolt, wherein each lug has a radial-extremity surface and each locking lug has a proximal surface that is perpendicular to the longitudinal axis;

wherein the inner receiver surface comprises an axial portion that is entirely distal of the lug stops, wherein said axial portion has radially-inwardly-protruding ramps comprising troughs with a trough diameter and crests with a crest diameter that is smaller than said trough diameter; and wherein the bolt slides axially to place the locking lugs entirely distal of the lug stops in an unlocked position, and the bolt is rotatable from the unlocked position to a locked position wherein at least a portion of said radial-extremity surface of each of said locking lugs mates with the crests so that the bolt is centered in the receiver boltway.

6. The firearm action as in claim 5, wherein each lug stop has a distal extremity that is perpendicular to the longitudinal axis, wherein, in said locked position, the locking lugs are entirely distal of said distal extremity.

7. The firearm action as in claim 5, wherein each of the locking lugs has a maximum diameter that is at said at least a portion of the radial-extremity surface.

8. The firearm action as in claim 5, wherein the distal end comprises a barrel-tenon-receiving space that is distal of the locking lugs in said locked position for receiving an unthreaded proximal end of the firearm barrel, and distal end threads that are distal of the barrel-tenon-receiving space for connection to threads of the firearm barrel.

9. The firearm action as in claim 8, wherein said crests and troughs extend into said barrel-tenon-receiving space.

10. The firearm action as in claim 8, wherein said barrel-tenon-receiving space is surrounded and defined by a cylindrical portion of said receiver inner surface.

11. The firearm action as in claim 5, wherein said at least a portion of said radial-extremity surface of each of said locking lugs is less than 0.0040 inches from the crest in the locked position.

12. The firearm action as in claim 11, wherein said at least a portion of said radial-extremity surface of each of said locking lugs is greater than or equal to 0.010 inches from the trough in the unlocked position.

13. The firearm action of claim 12, wherein the crest has a minimum diameter and the trough has a maximum diameter, and the minimum diameter of the crest is at least 0.006 inches smaller than the maximum trough diameter.

14. The firearm action as in claim 11, wherein said at least a portion of said radial-extremity surface is an area of maximum locking lug diameter that is less than 0.0040 inches from the crest in the locked position.

15. The firearm action as in claim 14, wherein the area of maximum locking lug diameter is greater than or equal to 0.010 inches from the trough in the unlocked position.

16. The firearm action of claim 15, wherein the crest has a minimum diameter and the trough has a maximum diameter, and the minimum diameter of the crest is at least 0.006 inches smaller than the maximum trough diameter.

17. The firearm action of claim 5, wherein the crest has a minimum diameter and the trough has a maximum diameter, and the minimum diameter of the crest is at least 0.006 inches smaller than the maximum trough diameter.

18. The firearm action as in claim 5, wherein said radial-extremity surface of each said lug has an area of maximum diameter that is the portion that mates with the crests and at least one recessed area of smaller diameter, the at least one recessed area being distal or proximal relative to said area of maximum diameter for collecting debris during rotation of the bolt.

19. The firearm action as in claim 5, wherein said radial-extremity surface of each said lug has an area of maximum diameter that is the portion that mates with the crests and recessed areas of smaller diameter distal and proximal relative to said area of maximum diameter for collecting debris during rotation of the bolt.

20. The firearm action of claim 5, wherein said radially-inwardly-protruding ramps further comprise transition areas extending between the troughs and the crests for scraping said radial-extremity surface of each said lug, when the lugs move into the locked position, to move debris off said radial-extremity surface and into the troughs.

21. The firearm action as in claim 5, wherein said multiple locking lugs comprise only two lugs, and said axial portion of the inner receiver surface comprises only two of said troughs and only two of said crests, wherein the two lugs are diametrically opposed on the bolt, the two troughs are diametrically opposed, and the two crests are diametrically opposed.

22. The firearm action as in claim 21, wherein said axial portion of the inner receiver surface is generally oval in shape.

* * * * *